US008350455B2

(12) United States Patent
Kameda et al.

(10) Patent No.: US 8,350,455 B2
(45) Date of Patent: Jan. 8, 2013

(54) SPARK PLUG INCLUDING GROUND ELECTRODE HAVING A PROTRUSION AND A HOLE

(75) Inventors: Hiroyuki Kameda, Aichi-gun (JP); Kohei Katsuraya, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/120,870

(22) PCT Filed: Oct. 1, 2009

(86) PCT No.: PCT/JP2009/005077

§ 371 (c)(1),
(2), (4) Date: Mar. 24, 2011

(87) PCT Pub. No.: WO2010/038467

PCT Pub. Date: Apr. 8, 2010

(65) Prior Publication Data

US 2011/0175515 A1 Jul. 21, 2011

(30) Foreign Application Priority Data

Oct. 1, 2008 (JP) ..... 2008-256719

(51) Int. Cl.
*H01T 13/20* (2006.01)

(52) U.S. Cl. ..... 313/141; 313/118

(58) Field of Classification Search ..... 313/118, 313/140, 141, 143; 445/7
See application file for complete search history.

(56) References Cited

U.S. PATENT DOCUMENTS 4,109,633 A 8/1978 Mitsudo et al.
6,831,397 B2 12/2004 Kanao et al.
2006/0220511 A1 10/2006 Hanashi et al.
2010/0289397 A1 11/2010 Hanashi et al.

FOREIGN PATENT DOCUMENTS

JP 52-036238 A 3/1977
JP 3702838 B2 10/2005
JP 2006-286469 A 10/2006
JP 2009-54574 A 3/2009
JP 2009-054579 A 3/2009

OTHER PUBLICATIONS

Shin Nishioka, et al., "Super Ignition Spark Plug with Wear Resistive Electrode", Sae Technical Paper Series, 2008-01-0092, Apr. 2008, www.sae.org, SAE International.

*Primary Examiner* — Joseph L Williams
(74) *Attorney, Agent, or Firm* — Sughrue Mion, PLLC

(57) ABSTRACT

It is an object of the present invention to provide a spark plug that can be produced at low cost and secure compatibility between ignition performance and durability. The spark plug according to the present invention includes a center electrode and a ground electrode having an inner surface facing the center electrode, characterized in that; the ground electrode has a protrusion and a hole; the protrusion protrudes from the inner surface by a protruding length A of 0.4 to 1 mm and has a first straight portion with a projected first straight portion area S1 of 1.5 to 3 $mm^2$; the hole has an opening at an outer surface of the ground electrode, a second straight portion, a bottom portion and a transition portion; the opening is formed in such a manner that the ratio (S2/S1) of a projected opening area S2 of the opening to the projected first straight portion area S1 is not less than 1.2; and the transition portion is in the form of a taper portion.

10 Claims, 16 Drawing Sheets

(a)

(b)

(a)

(b)

(a)

(b)

(a)

(b)

(a)

(b)

(a)

(b)

SPARK PLUG INCLUDING GROUND ELECTRODE HAVING A PROTRUSION AND A HOLE

CROSS-REFERENCE TO RELATED APPLICATION

This application is a National Stage of International Application No. PCT/JP2009/005077, filed on Oct. 1, 2009, which claims the benefit of priority from Japanese Patent Application number 2008-256719, filed on Oct. 1, 2008, the contents of all of which are incorporated herein by reference in their entirety.

TECHNICAL FIELD

The present invention relates to a spark plug, and more particularly, to a spark plug for an internal combustion engine.

BACKGROUND ART

In recent years, it is strongly demanded that internal combustion engines such as automotive internal combustion engines address low power consumptions and regulate carbon dioxide emissions and unburned gas emissions from the viewpoint of global environmental protection. In order to meet such a demand, new types of internal combustion engines such as lean-burn engines, direct-injection engines and low-emission engines have been developed. For ignition of air-fuel mixtures in these developed internal combustion engines and for efficient ignition of air-fuel mixtures in the conventional internal combustion engines, there is a need for spark plugs that have higher ignition performance than conventional ones.

As one type of such a high-ignition-performance spark plug, a spark plug is known which includes a center electrode, a noble metal tip welded to a front end of the center electrode, a ground electrode and a noble metal tip welded to a front end of the ground electrode facing the center electrode so as to generate a spark discharge between the noble metal tips.

Patent Document 1 discloses a spark plug that includes a center electrode (30) and a ground electrode (40) arranged facing each other, with a spark gap (50) left between the center and ground electrodes, and a noble metal tip (45) joined at one end thereof by laser welding to a spark-gap-side surface (43) of the ground electrode, wherein the cross sectional area of the other end of the noble metal tip is in the range of 0.12 $mm^2$ to 1.55 $mm^2$; wherein the length (L) of protrusion of the noble metal tip from the ground electrode is in the range of 0.3 mm to 1.5 mm; and wherein there is formed a fused part (47) in which the ground electrode and the noble metal tip are fused together so that the outer surface (47*a*) of the fused part linking the circumferential surface (45*a*) of the noble metal tip with the surface (43) of the ground electrode to which the noble metal tip is joined has a concave curved shape with a radius (R) of curvature of 0.1 mm to 1.0 mm.

The noble metal tips of the respective electrodes are formed of alloys containing noble metals such as platinum and iridium as main components. As these alloys are expensive, there is a problem that the spark plugs with the noble metal tips increase in cost.

Another type of spark plug in which the electrode has a protrusion formed by processing the ground electrode itself in place of the noble metal tip has also been proposed. For example, there is proposed a technique of forming a protrusion on one side of the ground electrode by extruding the opposite side of the ground electrode. More specifically, Non-Patent Document 1 mentions as follows: "This feature enables it to be pushed-out directly from top towards center electrode as shown in FIG. 16. By conducting this process, new fine-wired portion was achieved with smaller material cost and a more simple production way when compared to the conventional fine-fired electrode.", that is, teaches that the ground electrode can be produced at low cost by extrusion process.

PRIOR ART DOCUMENTS

Patent Document

Patent Document 1: Japanese Patent No. 3702838

Non-Patent Document

Non-Patent Document 1: Shin Nishioka, Ken Hanashi, Shinichi Okabe, "SAE TECHNICAL PAPER SERIES 2008-01-0092", issued by SAE International on Apr. 14, 2008, Chapter 3 on right column of Page 7

SUMMARY OF THE INVENTION

Problems to be Solved by the Invention

The present inventors have newly found that, even when the ground electrode is formed with a protrusion, more specifically with a sufficient protrusion to attain high ignition performance, by simply conducting extrusion process as described in Non-Patent Document 1, the spark plug may not show so high ignition performance contrary to expectations and deteriorates in durability due to the occurrence of a breakage or crack in the ground electrode or protrusion during use and/or due to the poor formation of the protrusion.

It is accordingly an object of the present invention to provide a spark plug that can be produced at low cost and ensure compatibility between ignition performance and durability.

Means for Solving the Problems

The present inventors have made extensive researches on the formation of a protrusion and a hole by extrusion process on a ground electrode and, as a result, have found that it is important that the extruded protrusion and hole satisfy some specific conditions for compatibility between ignition performance and durability. The present invention is based on such a finding.

In other words, the present invention provides, as a solution to the above problems, a spark plug comprising: a center electrode; and a ground electrode bent to face a front end of the center electrode with a spark gap defined therebetween and having an inner surface facing the center electrode, characterized in that: the ground electrode has a protrusion and a hole formed by extrusion process on a front end portion thereof; the protrusion protrudes from the inner surface toward the front end of the center electrode, has a protruding length A of 0.4 to 1 mm from the inner surface, and includes a first straight portion formed in such a manner that a width of the protrusion in a cross section through a center axis of the protrusion is uniform along a center axis direction of the protrusion and that the first straight portion has a projected first straight portion area S1 of 1.5 to 3 $mm^2$ where the projected first straight portion area S1 is a projected area of the first straight portion on a plane perpendicular to the center axis of the protrusion; the hole has an opening at an outer surface of the ground electrode opposite the inner surface and includes a second straight portion that has an inner wall surface formed in such a manner that a width between opposite sides of the inner wall surface in a cross section through a center axis of the hole is uniform along a center axis direction of the hole, a bottom portion and a transition portion extending between the second straight portion and the bottom portion; the opening is formed in such a manner that a contour of the first straight portion of the protrusion projected onto an imaginary plane perpendicular to the protruding direction of the protrusion is located inside of a contour of the opening projected on said imaginary plane and that a ratio (S2/S1) of a projected opening area S2 of the opening to the projected first straight portion area S1 is not less than 1.2; the transition portion is in the form of a taper portion that has, in a cross section through the center axis of the hole, straight contours extending from ends of contours of the second straight portion to ends of contours of the bottom portion; and the hole has, in a cross section through the center axis of the hole, a distance a of 0.1 mm or greater and a distance b of 0.1 mm or greater where the distance a is a distance from an intersection of a contour of the bottom portion and a contour of the taper portion to an intersection of an extension line of a contour of the second straight portion and an extension line of the contour of the bottom portion; and the distance b is a distance from an intersection of the contour of the second straight portion and the contour of the taper portion to the intersection of the extension line of the contour of the second straight portion and the extension line of the contour of the bottom portion.

The present invention also provides, as another solution to the above problems, a spark plug comprising: a center electrode; and a ground electrode bent to face a front end of the center electrode with a spark gap defined therebetween and having an inner surface facing the center electrode, characterized in that: the ground electrode has a protrusion and a hole formed by extrusion process on a front end portion thereof; the protrusion protrudes from the inner surface toward the front end of the center electrode, has a protruding length A of 0.4 to 1 mm from the inner surface, includes a first straight portion formed in such a manner that a width of the protrusion in a cross section through a center axis of the protrusion is uniform along a center axis direction of the protrusion and that the first straight portion has a projected first straight portion area S1 of 1.5 to 3 $mm^2$ where the projected first straight portion area S1 is a projected area of the first straight portion on a plane perpendicular to the center axis of the protrusion, and further includes at least one edge formed on a surface of the first straight portion; the hole has an opening at an outer surface of the ground electrode opposite the inner surface; and the opening is formed in such a manner that a contour of the first straight portion of the protrusion projected onto an imaginary plane perpendicular to the protruding direction of the protrusion is located inside of a contour of the opening projected on said imaginary plane and that a ratio (S2/S1) of a projected opening area S2 of the opening to the projected first straight portion area S1 is not less than 1.2.

In the present invention, the following configurations are preferred.

(1) The first straight portion of the protrusion has a curved surface located on a side thereof closer to a rear end of the ground electrode.

(2) The ground electrode has, in a cross section perpendicular to the center axis of the hole and in parallel to the outer surface, smallest thickness regions each defined between closest parts of contours of the hole and of the ground electrode and located on a front end side thereof (3) The ground electrode has, in a cross section through the center axis of the protrusion, a distance B of 0.3 mm or more and a distance C of 0.4 mm or more where the distance B is a distance from an intersection of an imaginary straight extension line of a straight contour of the first straight portion along the center axis of the protrusion and a contour of the hole to a closest point on an end of the straight contour of the first straight portion closest to a contour of the inner surface of the ground electrode; and the distance C is a distance from a corner of the hole on an end of the contour of the bottom portion to the closest point closer to the corner.

(4) The protrusion includes a protrusion base portion located between the inner surface and the first straight portion and having, in a cross section through the center axis of the protrusion, curved contours extending from contours of the inner surface to contours of the first straight portion; and wherein the protrusion base portion is formed with a radius of curvature of 0.1 to 0.3 mm between the first straight portion and the inner surface in such a manner that a contour of the protrusion base portion projected onto an imaginary plane perpendicular to the protruding direction of the protrusion is located inside a contour of the opening projected onto the imaginary plane perpendicular to the protruding direction of the protrusion.

(5) The protrusion and the hole satisfy a relationship of S4<S1<S2 where S1 is the projected first straight portion area; S2 is the projected opening area; and S4 is a projected bottom surface area of the hole as determined when the bottom portion of the hole, the first straight portion and the opening of the hole are projected on the imaginary plane perpendicular to the protruding direction of the protrusion.

It is also another preferred configuration of the present invention that a ratio (V2/V1) of a volumetric capacity V2 of the hole to a volume V1 of the protrusion is in the range of 1.2 to 2.

Effects of the Invention

The spark plug according to the present invention includes a ground electrode that has a protrusion and a hole formed by extrusion process on a front end portion thereof and satisfies the following characteristic features: the protrusion has a protruding length A of 0.4 to 1 mm from the inner surface of the ground electrode: the first straight portion has a projected first straight portion area S1 of 1.5 to 3 $mm^2$; the hole has an opening formed at the outer surface of the ground electrode in such a manner that the first straight portion is, when projected in the protruding direction of the protrusion, located inside the opening and that the area ratio (S2/S1) of the opening area S2 of the opening to the projected first straight portion area S1 is 1.2 or more; and the hole is recessed from the outer surface and includes a second straight portion formed with a uniform circumference and a taper portion linked to the second straight portion and formed with a taper rate of 0.1 mm or more. Alternatively, the spark plug according to the present invention may satisfy the feature that the protrusion has at least one edge on the surface of the first straight portion in place of the feature that the hole has the second straight portion and the taper portion.

The spark plug according to the present invention, in which the ground electrode has the above characteristic features, can be produced at low cost as the protrusion is formed by extrusion process on the ground electrode in place of a noble metal tip. Further, the formation of the taper portion on the hole or the formation of the edge on the protrusion makes it likely that a spark discharge can be easily generated at the protrusion, but less likely that a breakage and a crack will occur in the ground electrode, so as to attain high ignition performance and durability and low electrode consumption. It is therefore possible that the spark plug according to the present invention can be produced at low cost and secure compatibility between ignition performance and durability.

The following configurations are preferred in the present invention.

(1) The first straight portion of the protrusion has a curved surface located on a side thereof closer to a rear end of the ground electrode.

(2) The ground electrode has, in a cross section perpendicular to the center axis of the hole and in parallel to the outer surface, smallest thickness regions each defined between closest parts of contours of the hole and of the ground electrode and located on a front end side thereof.

(3) The ground electrode has, in a cross section through the center axis of the protrusion, a distance B of 0.3 mm or more and a distance C of 0.4 mm or more where the distance B is a distance from an intersection of an imaginary straight extension line of a straight contour of the first straight portion along the center axis of the protrusion and a contour of the hole to a closest point on an end of the straight contour of the first straight portion closest to a contour of the inner surface of the ground electrode; and the distance C is a distance from a corner of the hole on an end of the contour of the bottom portion to the closest point closer to the corner.

(4) The protrusion includes a protrusion base portion located between the inner surface and the first straight portion and having, in a cross section through the center axis of the protrusion, curved contours extending from contours of the inner surface to contours of the first straight portion; and wherein the protrusion base portion is formed with a radius of curvature of 0.1 to 0.3 mm between the first straight portion and the inner surface in such a manner that a contour of the protrusion base portion projected onto an imaginary plane perpendicular to the protruding direction of the protrusion is located inside a contour of the opening projected onto the imaginary plane perpendicular to the protruding direction of the protrusion.

(5) The protrusion and the hole satisfy a relationship of $S4<S1<S2$ where S1 is the projected first straight portion area; S2 is the projected opening area; and S4 is a projected bottom surface area of the hole as determined when the bottom portion of the hole, the first straight portion and the opening of the hole are projected on the imaginary plane perpendicular to the protruding direction of the protrusion.

It is possible according to any of these preferred configurations of the present invention to secure higher ignition performance and durability.

It is also another preferred configuration of the present invention that a ratio (V2/V1) of a volumetric capacity V2 of the hole to a volume V1 of the protrusion is in the range of 1.2 to 2. It is possible according to this another preferred configuration of the present invention to secure higher ignition performance and durability.

BRIEF DESCRIPTION OF DRAWINGS

FIG. 1(*b*) is a section view of substantive part of one embodiment of the spark plug according to the present invention.

FIG. 2(*b*) is a projection view of the front end portion of the ground electrode, when projected in the protruding direction of a protrusion of the ground electrode, in one embodiment of the spark plug according to the present invention.

FIG. 3(*b*) is an enlarged section view of a front end portion of a ground electrode that does not fall within the scope of the present invention.

FIG. 6(*b*) is an enlarged section view of the front end portion of the ground electrode in one embodiment of the spark plug according to the present invention.

FIG. 7(*b*) is an enlarged view of the taper portion of the hole shown in FIG. 7(*a*).

FIG. 18(*b*) is a projection view of the front end portion of the ground electrode of the spark plug, when projected in the protruding direction of a protrusion of the ground electrode.

FIG. 23(*b*) is a projection view of the front end portion of the ground electrode when projected in the protruding direction of the protrusion of the ground electrode.

BEST MODES FOR CARRYING OUT THE INVENTION

The spark plug according to the present invention has a center electrode and a ground electrode bent in such a manner as to define a spark gap between a front end face of the center electrode and the ground electrode and having an inner surface facing the center electrode. In the present invention, there is no particular limitation on the configuration of the spark plug. Various configurations of the spark plug are possible as long as the spark plug is configured to generate a spark discharge in the spark gap. The spark plug according to the present invention, in which the ground electrode has the above-mentioned features, can be produced at low cost and attain high ignition performance and durability.

Embodiments of the spark plug according to the present invention will be described in detail below. It is however to be understood that the spark plug according to the present invention is not limited to the following embodiments as long as the ground electrode of the spark plug has the above-mentioned features.

Figure 1:
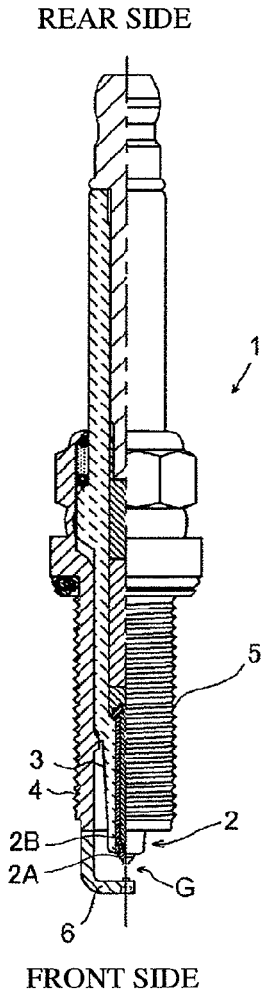
FIG. 1 is a schematic view of a spark plug as one embodiment of the spark plug according to the present invention, wherein FIG. 1(*a*) is a general schematic view, partially in section, of one embodiment of the spark plug according to the present invention.
Figure 1:
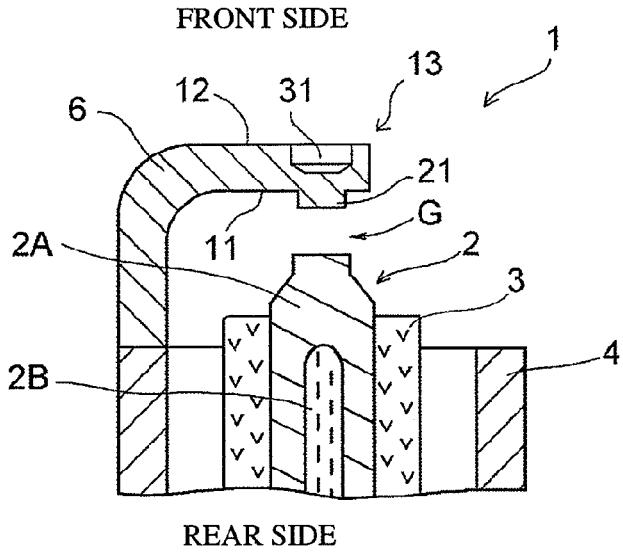

FIG. 1 shows a spark plug 1 as one embodiment of the spark plug according to the present invention. As shown in FIGS. 1(*a*) and 1(*b*), the spark plug 1 has a substantially rod shaped center electrode 2, a substantially cylindrical shaped insulator 3 arranged around the center electrode 2, a cylindrical metal shell 4 holding therein the insulator 3 and a ground electrode 6 having one end facing a front end face of the center electrode 2, with a spark gap G defined therebetween, and the other end joined to an end of the metal shell 4. Hereinafter, the term "front" refers to the side of the spark plug 1 where the ground electrode 6 is located in the metal shell 4 (e.g. the bottom side of FIG. 1(*a*)); and the term "rear" refers to the side opposite the front side (e.g. the top side of FIG. 1(*a*)) for the sake of convenience.

As shown in FIG. 1, the metal shell 4 is cylindrical in shape so that the insulator 3 is inserted and held in the metal shell 4. A threaded portion 5 by which the spark plug 1 is mounted to a cylinder head of an internal combustion engine (not shown) is formed on an outer surface of a front portion of the metal shell 4. The metal shell 4 can be made of a conductive steel material such as low carbon steel.

The insulator 3 is held in the metal shell 4 via a talc or packing (not shown) and has an axial hole to retain therein the center electrode 2 along an axis direction thereof as shown in FIG. 1. Herein, the insulator 3 is fixed to the metal shell 4 with a front end of the insulator 3 protruding from a front end face of the metal shell 4. The insulator 3 can be made of any material that is difficult to conduct heat, such as alumina-based sintered ceramic material.

As clearly shown in FIG. 1(*b*), the center electrode 2 has an outer electrode member 2A and an inner electrode member 2B coaxially embedded in an axis portion of the outer electrode member 2A. Further, the center electrode 2 is fixed in the axial hole of the insulator 3 with a front end of the center electrode 2 protruding from a front end face of the insulator 3. The front end of the center electrode 2 includes a conical portion gradually decreasing in outer diameter toward the front and a cylindrical portion extending on a front side of the conical portion and having a uniform outer diameter as clearly shown in FIG. 1(*b*). The center electrode 2 can be formed of a known material. For example, the outer and inner electrode members 2A and 2B can be formed of a high heat- and wear-resistant Ni-based alloy material and a high heat-conductive metal material e.g. copper or silver, respectively.

The form and structure of the ground electrode 6 are designed in such a manner that the ground electrode 6 has e.g. a rectangular column shape joined at one end thereof to the end of the metal shell 4, or more specifically, the end face of the metal shell 4 and bent into a substantially L-letter profile so as to allow a front end portion 13 of the ground electrode 6 to be located adjacent to the center electrode 2. With such a design, the ground electrode 6 can be so arranged that the other end of the ground electrode 6 faces the center electrode 2 through the spark gap G. That the ground electrode 6 can preferably be formed of e.g. a Ni-based alloy material higher in heat resistance and wear resistance than the Ni-based alloy material of the center electrode 2 in view of the fact that the ground electrode 6 is exposed to higher temperature conditions than the center electrode 2.

In the above-configured spark plug 1, the ground electrode 6 has the following characteristic features. One of the features of the ground electrode 6 is that a protrusion 21 and a hole 31 are formed by extrusion process on the front end portion 13 of the ground electrode 6. More specifically, the protrusion 21 protrudes from an inner surface 11 of the ground electrode 6 facing the center electrode 2 toward the front end of the center electrode 2; and the hole 31 has an opening 51 (not shown in FIG. 1(*b*)) at an outer surface 12 of the ground electrode 6 opposite the inner surface 11.

Figure 2:
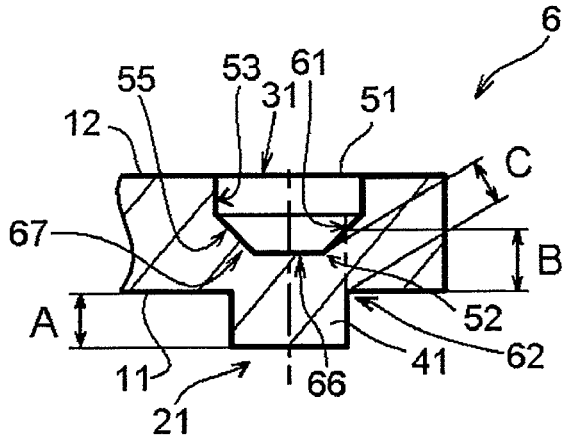
FIG. 2 is an enlarged view of a front end portion of a ground electrode in one embodiment of the spark plug according to the present invention, wherein FIG. 2(*a*) is an enlarged section view of the front end portion of the ground electrode in one embodiment of the spark plug according to the present invention.
Figure 2:
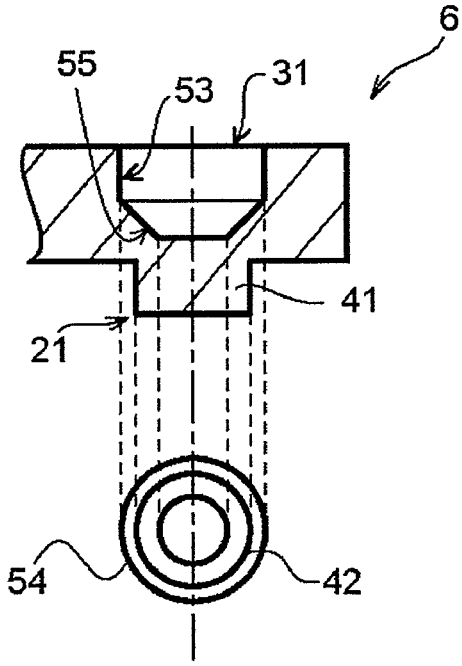

The protrusion 21 is in the form of a circular column that protrudes from the inner surface 11 of the ground electrode 6 and is substantially circular in cross section perpendicular to the protruding direction of the protrusion 21 as clearly shown in FIGS. 1(*b*) and 2(*a*). As shown in FIG. 2(*a*), the protrusion 21 includes a first straight portion 41 formed in such a manner that a width of the protrusion 21 in a cross section through the center axis of the protrusion 21 is uniform along the center axis direction of the protrusion 21, i.e., the protrusion 21 is uniform in width when viewed in the center axis direction thereof. Namely, in the present embodiment, the width of the first straight portion 41 of the protrusion 21 in the direction perpendicular to the protruding direction is uniform along the center axis direction of the protrusion 21 when viewed in a cross section of the ground electrode 6 through the center axis of the spark plug 1 and through the center axis of the ground electrode 6 as shown in FIG. 2(*a*).

The spark gap G is defined between the protrusion 21 and the front end face of the center electrode 2 and is generally set to 0.3 to 1.5 mm. In the present embodiment, the protruding direction of the protrusion 21 is in agreement with the center axis direction of the protrusion 21 and with the center axis direction of the spark plug 1 as shown in FIG. 1(*b*).

Another feature of the ground electrode 6 is that the protruding length A of the protrusion 21 from the inner surface 11 of the ground electrode 6 is in the range of 0.4 to 1 mm. If the protruding length A is less than 0.4 mm, the ignition performance may deteriorate. If the protruding length A exceeds 1 mm, the protrusion 21 becomes more susceptible to wear by spark discharges and thus may deteriorate in durability. The protruding length A is preferably in the range of 0.5 to 0.9 mm, more preferably 0.6 to 0.8 mm, for good balance between ignition performance and durability.

Still another feature of the ground electrode 6 is that the projected first straight portion area S1 of a cross section of the protrusion 21 through the first straight portion 41 perpendicular to the protruding direction is in the range of 1.5 to 3 $mm^2$. If the projected first straight portion area S1 is less than 1.5 $mm^2$, the protrusion 21 becomes more susceptible to wear by spark discharges and thus may deteriorate in durability. If the projected first straight portion area S1 exceeds 3 $mm^2$, the ignition performance improvement effect of the protrusion 21 may not be recognized. The projected first straight portion area S1 is preferably in the range of 1.6 to 2.5 $mm^2$, more preferably 1.6 to 2 $mm^2$, for good balance between ignition performance and durability.

As clearly shown in FIG. 2(*a*), the hole 31 is recessed from the outer surface 12 of the ground electrode 6 toward the inner surface 11 opposite the outer surface 12 and is open through the opening 51. The hole 31 is in the form of a bottomed cylindrical hole that is substantially circular in cross section perpendicular to the center axis direction of the hole 31. The center axis of the hole 31 is substantially in agreement with the center axis of the protrusion 21. Another feature of the ground electrode 6 is that the hole 31 has its opening 51 at the outer surface 12 opposite the inner surface 11 and includes a second straight portion 53, a bottom portion 66 and a transition portion 67 as shown in FIG. 2(*a*). The opening 51 refers to a region open to the outer surface 12 and surrounded by a boundary between the outer surface 12 and the second straight portion 53. The second straight portion 53, the bottom portion 66 and the transition portion 67 will be explained later in detail.

Another feature of the ground electrode 6 is that a contour of the first straight portion 41 projected on an imaginary plane perpendicular to the protruding direction of the protrusion 21 is located inside a contour of the opening 51 projected onto the imaginary plane perpendicular to the protruding direction of the protrusion 21. This feature is specifically shown in FIG. 2(*b*), which is a projection view of the opening 51 and the protrusion 21 on the imaginary plane perpendicular to the protruding direction of the protrusion 21. It means that, in FIG. 2(*b*), a projected opening region 54 is located inside a projected first straight portion region 42 where the projected opening region 54 is a region inside the projected contour of the opening 51 on the imaginary plane; and the projected first straight portion region 42 is a region inside the projected contour of the first straight portion 41 of the protrusion 21 on the imaginary plane. It is also one embodiment of the spark plug according to the present invention that the projected opening region 54 and the projected first straight portion region 42 coincide with each other. Upon satisfaction of the above relationship of the projected regions on the imaginary plane, it is less likely that the protrusion 21 and/or part of the ground electrode 6 adjacent to the protrusion 21 will sustain a crack or poor formation due to the extrusion process so that both of the ground electrode 6 and the protrusion 21 can ensure high durability and low production cost. It is possible to attain high ignition performance and durability even when the protrusion 21 is formed by the extrusion process in place of the noble metal tip.

Another feature of the ground electrode 6 is that the ratio (S2/S1) of a projected area S2 of the opening 51 to the projected area S1 of the first straight portion is not less than 1.2. When the area ratio (S2/S1) is less than 1.2, it is less likely that the protrusion 21 and/or part of the ground electrode 6 adjacent to the protrusion 21 will sustain a crack or poor formation due to the extrusion process so that both of the ground electrode 6 and the protrusion 21 can ensure high durability. There is no particular limitation of the upper limit of the area ratio (S2/S1) as long as the projected first straight portion area S1 and the protruding length A fall within the above specified ranges. The upper limit of the area ratio (S2/S1) can be set to, for example, 4.

As shown in FIG. 2(*a*), the second straight portion 53 has an inner wall surface formed in such a manner that a distance between opposite sides of the inner wall surface in a cross section through the center axis of the hole 31 is uniform along the center axis direction of the hole 31. Further, the second straight portion 53 starts from the opening 51 and extends in the direction from the outer surface 12 to the inner surface 11 along the center axis of the protrusion 21. The bottom portion 66 refers to a region defining a bottom surface of the hole 31 and formed by pressing some part of the outer surface 12 in the direction from the outer surface 12 to the inner surface 11 during the extrusion process.

The transition portion 65 refers to a region extending from the second straight portion 53 to the bottom portion 66. The transition portion 65 does not thus exist in such an embodiment that the second straight portion and the bottom portion intersect directly each other in the cross section through the center axis of the ground electrode.

In the ground electrode 6, the transition portion 67 of the hole 31 is in the form of a taper portion 55 that gradually decreases in inner diameter toward the inner surface 11 as shown in FIG. 2(*a*). Namely, the hole 31 is provided with the opening 51, the second straight portion 53, the taper portion 55 and the bottom portion 66. The taper portion 55 of the transition portion 67 has, in the cross section through the center axis of the hole 31, straight contours extending from ends of contours of the second straight portion 53 to ends of a contour of the bottom portion 66. In the present embodiment, the taper portion 55 is formed with a specific inclination pattern. The specific inclination pattern of the taper portion 55 will be explained later in detail.

Herein, the second straight portion of the ground electrode will be explained in more detail below with reference to FIG. 3.

Figure 3:
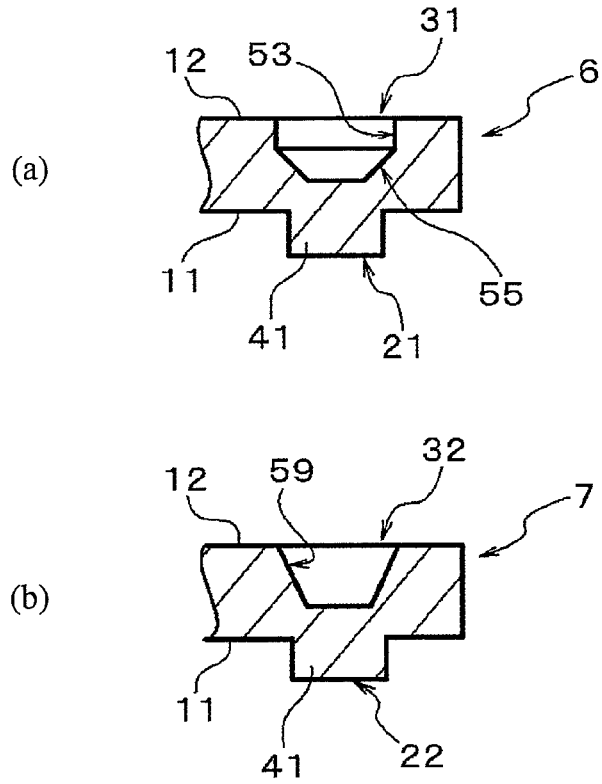
FIG. 3 is an enlarged section view of a front end portion of a ground electrode of a spark plug, wherein FIG. 3(*a*) is an enlarged section view of the front end portion of the ground electrode shown in FIG. 2(*a*)

FIG. 3(*a*) shows an illustration of the ground electrode 6 of FIG. 2(*a*), whereas FIG. 3(*b*) shows an illustration of a ground electrode 7 that has a taper portion 59 formed on the whole of the outer circumference of a hole 32 in place of the second straight portion 53 and the taper portion 55 of the hole 31 of the ground electrode 6.

In the case of producing the ground electrode of the spark plug according to the present invention by extrusion process, a part of the outer surface of the ground electrode in which the hole is formed is pressed whereby a part of the inner surface of the ground electrode on which the protrusion is formed is extruded by an amount corresponding to a thickness of the pressed part. It is herein preferable that the material of the pressed part in which the hole is formed is easy to flow toward the protrusion side in order that the protrusion can be readily formed into a desired shape with high dimensional accuracy. When there is an edge formed on the periphery of the front end face of the protrusion, i.e., on the intersection of the front end face and outer circumference surface of the protrusion, the spark plug can easily generate a spark discharge at such an edge of the protrusion and thus can secure high ignition performance.

In the production of the ground electrode 6 of FIG. 3(*a*) and the ground electrode 7 of FIG. 3(*b*) by extrusion process, the material of the pressed part is more likely to flow toward the protrusion side in the ground electrode 6 where not only the taper portion 55 but also the second straight portion 53 are formed on the hole 31 than in the ground electrode 7 where the taper portion 59 is formed by tapering the whole of the outer circumference of the hole 32. It is thus easier to form the protrusion 21 of the ground electrode 6 than to form the protrusion 22 of the ground electrode 7. Further, the dimensional accuracy of the protrusion 21 is higher than that of the protrusion 22. For these reasons, the ground electrode 6 with the second straight portion 53 is more preferred as one embodiment of the ground electrode of the spark plug according to the present invention in comparison to the ground electrode 7 with no second straight portion 53.

There is no particular limitation on the form of the hole. For example, the hole may be in the form of a bottomed circular, oval or polygonal column shaped hole that is circular, oval or polygonal in cross section perpendicular to the center axis direction of the hole. The profile of the hole may be the same as or different from that of the protrusion. Further, the center axis of the hole may be, or may not be, in agreement with the center axis of the protrusion.

Figure 4:
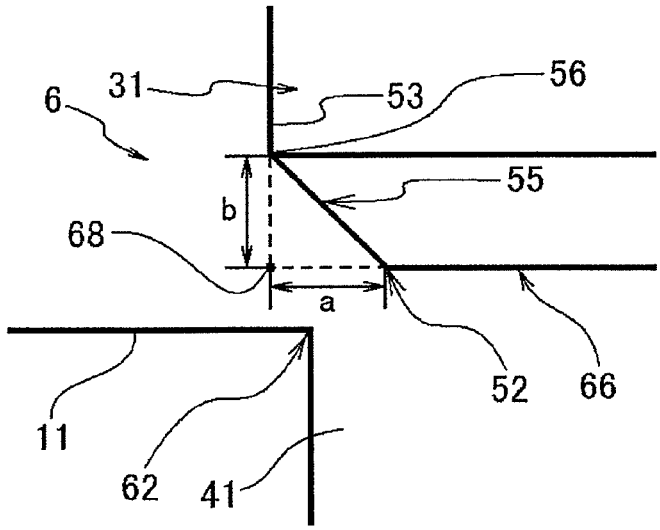
FIG. 4 is an enlarged view of a taper portion of the ground electrode in one embodiment of the spark plug according to the present invention.

The inclination pattern of the taper portion 55 of the ground electrode 6 will be explained below. FIG. 4 is an enlarged view of the vicinity of the taper portion 55 of the ground electrode 6. Although FIG. 4 shows a cross section of the ground electrode 6 through the center axis of the hole 31, the hatching lines of the cross section is omitted from FIG. 4 for convenience of explanation. There are indicated, in FIG. 4, a corner 52 at which the contour of the bottom portion 66 and the contour of the taper portion 55 intersect each other, an intersection 68 of extension lines of the contour of the second straight portion 53 and the contour of the bottom portion 66 and a corner 56 at which the contour of the second straight portion and the contour of the taper portion intersect with each other. In the ground electrode 6, the distance a between the corner 52 and the intersection 68 is 0.1 mm or more; and the distance b between the corner 56 and the intersection 68 is 0.1 mm or more. The occurrence and development of a crack in the vicinity of the hole 31 and the occurrence of a breakage in the vicinity of the hole 31 can be prevented when both of the distance a and the distance b are 0.1 mm or more. This leads to durability improvement under high temperature conditions.

The ground electrode may alternatively have the feature that at least one edge is formed on the surface of the first straight portion of the protrusion in place of the feature that the second straight portion and the transition portion are formed on the hole.

Figure 5:
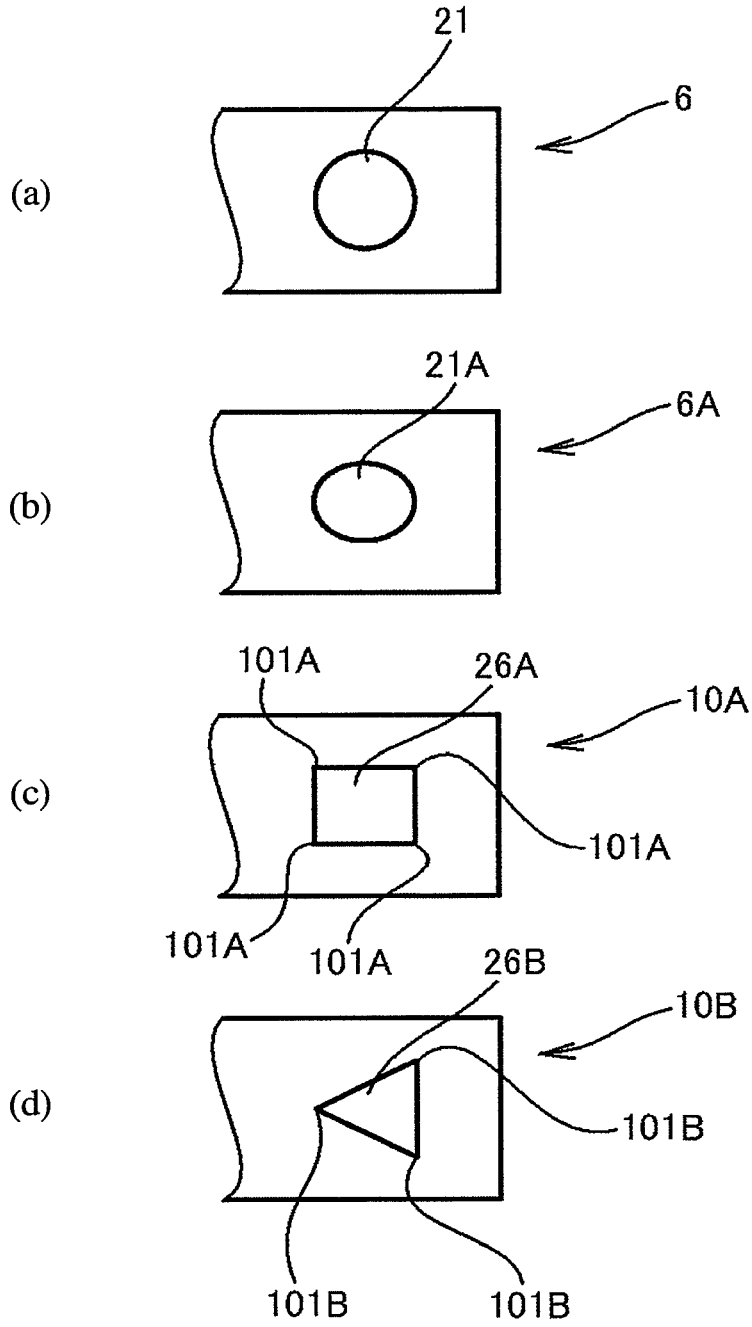
FIG. 5 is an enlarged view showing modifications of the protrusion of the ground electrode in one embodiment of the spark plug according to the present invention.

FIG. 5(*a*) to (*d*) shows an illustration of ground electrodes 6, 6A, 10A and 10B, and more specifically, protrusions of the ground electrodes when each viewed in the direction facing the front end face of the protrusion, i.e., when the spark plug is viewed in the direction from the rear side to the front side in FIG. 1(*b*).

The ground electrode 6 of FIG. 5(*a*) is that of FIG. 2. The ground electrode 6A of FIG. 5(*b*) is of the type where the protrusion 21 of the ground electrode 6 is modified into a different shape. The protrusion 21 of the ground electrode 6 has a circular column shape that is circular in a plane perpendicular to the center axis of the protrusion 21. The ground electrode 6A has an oval column shaped protrusion 21A that is oval in a plane perpendicular to the center axis of the protrusion 21A.

In each of the protrusion 21 and the protrusion 21A, no edge is formed on the surface of the first straight portion. In the ground electrode 10A of FIG. 5(*c*) and in the ground electrode 10B of FIG. 5(*d*), on the other hand, edges are formed on the surface of the first straight portion. The ground electrodes 10A and 10B are thus applicable to one embodiment of the spark plug according to the present invention.

The ground electrode 10A has a protrusion 26A; and the ground electrode 10B has a protrusion 26B. The protrusion 26A of the ground electrode 10A has a rectangular column shape that is rectangular in a plane perpendicular to the protruding direction of the protrusion 26A. The protrusion 26B of the ground electrode 10B has a triangular column shape that is triangular in a plane perpendicular to the protruding direction of the protrusion 26B. The edges are formed on a circumferential surface of the rectangular column shape and on a circumferential surface of the triangular column shape, each of which correspond to the surface of the first straight portion. More specifically, the protrusion 26A has four edges 101A formed along four intersections of four sides of the surface of the first straight portion. Similarly, the protrusion 26B has three edges 10B formed along three intersections of three sides of the surface of the first straight portion.

In comparison to the protrusion where no edge is formed on the surface of the first straight portion, e.g., the protrusion that is circular in cross section perpendicular to the center axis, the protrusion where the edge or edges are formed on the surface of the first straight portion, e.g., the protrusion that is polygonal in cross section perpendicular to the center axis can generate a higher field intensity on the edge or edges. The higher field intensity leads to a reduction in breakdown voltage so as to preferably decrease the amount of consumption of the electrode and decrease the possibility of perforation through the insulator by spark discharges. As the edges are formed on the surface of the protrusion in each of the ground electrodes 10A and 10B, the breakdown voltage can be reduced by the use of these ground electrodes 10A and 10B. In the spark plug according to the present invention, the protrusion can be of any cross section that forms at least one edge on the surface of the first straight portion, such as polygonal cross section e.g. triangular, rectangular, pentagonal or hexagonal cross section, or cross section defined by straight and curved lines e.g. sector cross section. In the case where the cross section of the protrusion is polygonal in shape, the center axis of the protrusion refers to a line passing through the center of gravity of the polygonal shape. Further, the second straight portion may not necessarily be formed on the hole as long as the edge or edges are formed on the surface of the first straight portion.

Other preferable features of the spark plug according to the present invention will be explained below.

It is preferable that the ground electrode 6 of FIG. 2 and the ground electrode 7 of FIG. 3 each have a protruding direction distance B of 0.3 mm or more as will be explained later, in addition to the above-mentioned features. When the protruding direction distance B is 0.3 mm or more, it is less likely that a crack and poor formation will occur due to the extrusion process so that the protrusion 21 of the ground electrode 6 and the protrusion 22 of the ground electrode 7 can ensure higher durability. There is no particular limitation on the upper limit of the protruding direction distance B. In view of the ease of formation of the protrusion 21, 22, the upper limit of the protruding direction distance B can be set to, for example, 1 mm. The protruding direction distance B is particularly preferably in the range of 0.5 to 0.8 mm.

In e.g. FIG. 2(*a*), the protruding direction distance B refers to, in a cross section through the center axis of the protrusion 21, a distance from an intersection 61 of an imaginary extension line of a straight contour of the first straight portion 41 along the center axis of the protrusion 21 and a contour of the hole 31 to a closest point 62 on an end of the straight contour of the first straight portion 41 closest to a contour of the inner surface 11 of the ground electrode 6. In FIG. 3(*a*), the protruding direction distance B refers to, in a cross section through the center axis of the protrusion 22, a distance from an intersection 63 of an imaginary extension line of a straight contour of the first straight portion 41 along the center axis of the protrusion 22 and a contour of the hole 32 to a closest point 64 on an end of the straight contour of the first straight portion 41 closest to a contour of the inner surface 11 of the ground electrode 7.

The protruding direction distance B can alternatively be defined as a minimum distance from the intersection 61, 63 to a point on the outer circumference of the first straight portion 41 along the protruding direction. In the present embodiment, the protruding direction distance B means a distance from the intersection 61 or 63 to the closest point 62, 64 on the outer circumference of the first straight portion 41 and on the inner surface 11 along the protruding direction in the cross section of the ground electrode 6 as shown in FIG. 2(*a*) or in the cross section of the ground electrode 7 as shown in FIG. 3(*a*) and corresponds to a difference between the thickness of the ground electrode 6, 7 and the depth of the hole 31, 32.

It is further preferable that, in the ground electrode 6 of FIG. 2, the minimum distance C between the corner 52 of the hole 31 and the closest point 62 is in the range of 0.4 mm or more and that, in the ground electrode 7 of FIG. 3, the minimum distance C between the corner 51 of the hole 32 and the closest point 64 is in the range of 0.4 mm or more.

Herein, the corner refers to an intersection of two planes among the surfaces of the hole and the outer surface located on an end of the contour of the bottom portion of the hole in a cross section through the center axis of the hole. The minimum distance C refers to, in a cross section through the center axis of the hole, a minimum distance from the edge to the closest point closer to the edge. In the ground electrode 6 where the taper portion 55 is formed on the hole 31, the corner 52 of the hole 31 corresponds to a boundary between the bottom portion 66 and taper portion 55 of the hole 31.

Namely, in the ground electrode 6, the minimum distance C means a distance from the corner 52 of the hole 31 at which the taper portion 55 and bottom portion 66 intersect each other to the closest point 62 closest to the corner 52 in the cross section of the ground electrode 6 through the center axis of the spark plug 1 and through the center axis of the ground electrode, i.e., in the cross section of the ground electrode 6 shown in FIG. 2(*a*).

When the minimum distance C is 0.4 mm or more, it is less likely that a crack and poor formation will occur due to the extrusion process so that the protrusion 21 of the ground electrode 6 and the protrusion 22 of the ground electrode 7 can ensure higher durability. There is no particular limitation on the upper limit of the minimum distance C. In view of the ease of formation of the protrusion 21, 22, the upper limit of the minimum distance C can be set to, for example, 1.5 mm. The minimum distance C is particularly preferably in the range of 0.6 to 0.9 mm.

It is also a preferred embodiment of the spark plug according to the present invention that, in a cross section of the ground electrode perpendicular to the center axis of the hole and in parallel with the outer surface, contours of the hole and of the ground electrode get closer to each other to define smallest thickness regions each between closest parts of the contours of the hole and of the ground electrode. This preferred embodiment will be explained in detail below with reference to FIG. 6.

Figure 6:
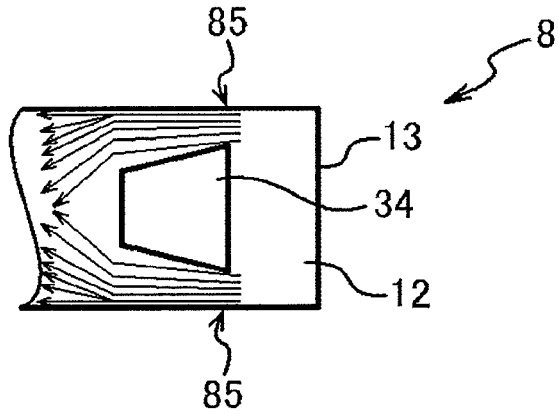
FIG. 6 is an enlarged section view of a front end portion of a ground electrode in one embodiment of the spark plug according to the present invention, wherein FIG. 6(*a*) is an enlarged section view of the front end portion of the ground electrode in one preferred embodiment of the spark plug according to the present invention.
Figure 6:
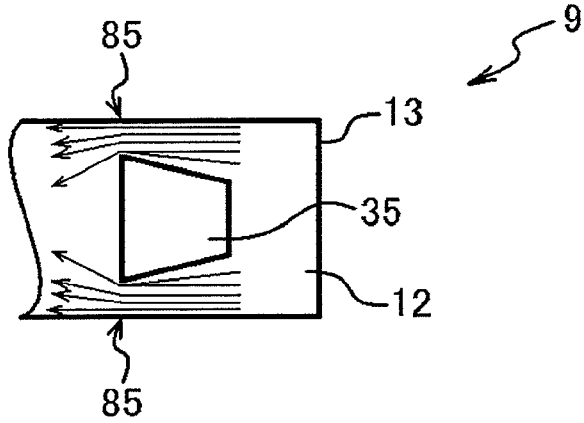

FIG. 6 shows an illustration of ground electrodes 8 and 9 of spark plugs. It is herein noted that the spark plug with the ground electrode 8 is one preferred embodiment of the spark plug according to the present invention. The ground electrode 8 of FIG. 6(*a*) has, in a cross section perpendicular to the center axis of a hole 34 and in parallel with the outer surface 12, contours of the hole 34 and of the ground electrode 8 get closer to each other to define smallest thickness regions 85 each between closest parts of the contours of the hole 34 and of the ground electrode 8. The smallest thickness regions 85 are located closer to the front end 13 of the ground electrode 8 as shown in FIG. 6(*a*). In the ground electrode 9 of FIG. 6(*b*), on the other hand, the smallest thickness regions 85 are located closer to the rear end rather than to the front end 13 of the ground electrode.

In FIG. 6(*a*) and (*b*), the arrows indicate the direction of heat transfer from the front end 13 toward the rear end of the ground electrode 8, 9 during heating. Heat transfers in the ground electrode more smoothly in the case of FIG. 6(*a*) where the small thickness region 85 is located closer to the front end 13 than in the case of FIG. 6(*b*) where the small thickness region 85 is located closer to the rear end. It is thus preferable that the smallest thickness regions are located on the front end side of the ground electrode so that the ground electrode, even if brought into a high temperature state due to the generation of a spark discharge during the use of the spark plug, can be prevented from becoming too high in temperature by efficient heat transfer. When the temperature of the ground electrode does not rise too high, it is less likely that the composition of the ground electrode will be thermally deteriorated. The spark plug can secure good durability as the ground electrode is resistant to thermal deterioration.

The occurrence of a crack and breakage can be prevented effectively by the formation of the taper portion 55 in the ground electrode 7 of FIG. 2. This crack/breakage prevention effect of the taper portion 55 will be explained below with reference to FIG. 7.

Figure 7:
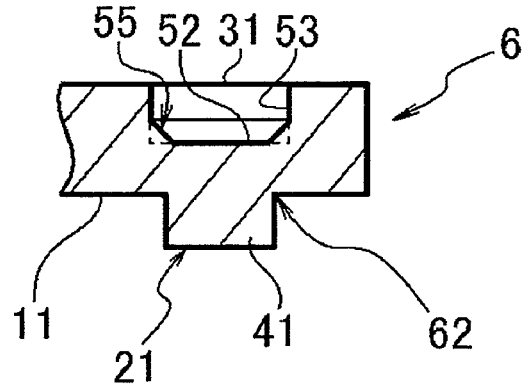
FIG. 7 is an enlarged section view of the front end portion of the ground electrode in one embodiment of the spark plug according to the present invention, wherein FIG. 7(*a*) is an enlarged section view of the front end portion of the ground electrode shown in FIG. 2(*a*)
Figure 7:
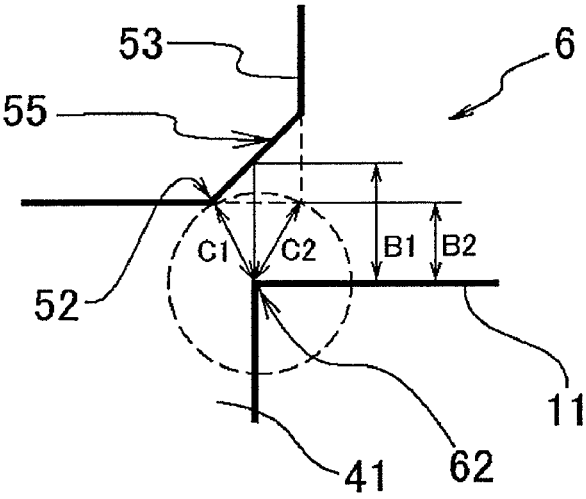

FIG. 7(*a*) is a view of the ground electrode 6 of FIG. 2(*a*); and FIG. 7(*b*) is an enlarged view of the vicinity of the taper portion 55 of the ground electrode 6. In FIG. 7(*a*), the dotted line indicates a contour of a hole having the same minimum distance C as the hole 31. More specifically, the minimum distance C1 of the hole is set to the same value as the minimum distance C2 of the hole with no taper portion as indicated by the dotted line in FIG. 7(*b*). In FIG. 7(*b*), the protruding direction distance B1 of the hole is greater than the protruding direction distance B2 of the hole with no taper portion as indicated by the dotted line. Namely, the protruding direction distance B can be increased by the formation of the taper portion on the hole when the minimum distance C of the hole is the same. It is thus preferable that the ground electrode of the spark plug has a large protruding direction distance B for less occurrence of a crack and a breakage in the protrusion of the ground electrode as mentioned above.

It is further preferable in the spark plug according to the present invention to form a curved surface on a side of the first straight portion closer to the rear end of the ground electrode. The rear end of the ground electrode refers to, in the case of FIG. 1(*b*), a region of the ground electrode 6 joined to the metal shell. Namely, the rear end of the ground electrode is located on the left side of the ground electrode 6 in FIG. 1(*b*) and is also located on the left side of the ground electrode in each of FIGS. 2, 3 and 5. It is herein noted that the region of the ground electrode opposite the rear end corresponds to the front end portion of the ground electrode.

More specifically, the ground electrode 6 of FIG. 5(*a*) and the ground electrode 6A of FIG. 5(*b*) are preferred as each of these ground electrodes has a curved surface on the side of the protrusion closer to the rear end, i.e., the left side of the protrusion in the drawing. In comparison to the ground electrode where the whole of the outer circumference of the protrusion is curved, the ground electrode where the edge or edges are formed on the outer circumference of the protrusion makes it possible that the spark plug can easily generate a spark discharge at the protrusion, notably at the edge or edges on the outer circumference of the protrusion, and thus can attain higher ignition performance. Further, the spark plug according to the present invention can attain higher ignition performance in the case of generating the spark discharge by the concentrated application of the voltage onto the side of the protrusion closer to the front end of the ground electrode rather than onto the side of the protrusion closer to the rear end of the ground electrode. The ground electrode where the protrusion has a curved surface on the side thereof closer to the rear end of the ground electrode and at least one edge on the side thereof closer to the front end of the ground electrode, i.e., both of the curved surface and the edge or edges are formed on the outer circumference of the protrusion is a more preferred embodiment than the ground electrode 6 of FIG. 5(*a*) and the ground electrode 6A of FIG. 5(*b*).

Figure 8:
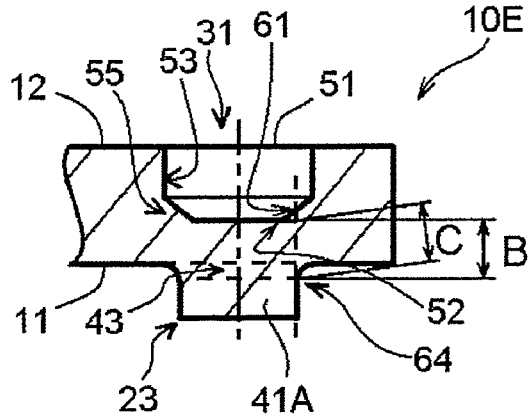
FIG. 8 is an enlarged section view of a front end portion of another type of ground electrode in one embodiment of the spark plug according to the present invention.
Figure 8:
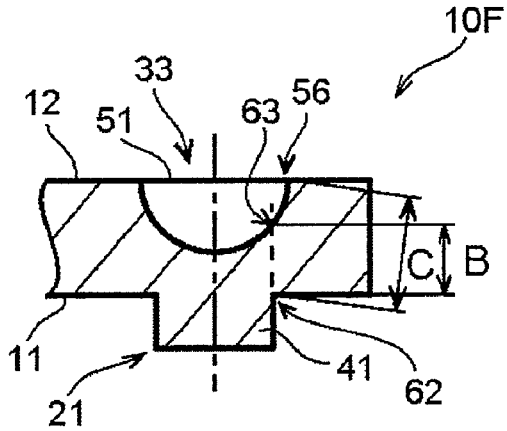

FIG. 8(*a*) shows an illustration of a ground electrode 10E as another embodiment of the ground electrode of the spark plug according to the present invention. The ground electrode 10E has the same features as the ground electrode 6. The spark plug with the ground electrode 10E is basically structurally the same as the spark plug, except for the ground electrode structure. The ground electrode 6 and the ground electrode 10E are different from each other in the presence or absence of a protrusion base portion 43.

As shown in FIG. 8(*a*), the ground electrode 10E includes a protrusion base portion 43 formed between the inner surface 11 and the first straight portion 41A in such a manner that the protrusion base portion 43 has, in a cross section through the center axis of the protrusion 23, curved contours extending from contours of the inner surface 11 to contours of the first straight portion 41. A contour of a boundary of the protrusion base portion 43 and the inner surface 11 projected onto an imaginary plane perpendicular to the protruding direction of the protrusion 23 is located inside a contour of the opening 51 projected onto the imaginary plane perpendicular to the protruding direction of the protrusion 23. It means that, when the hole 31 and the protrusion 23 are projected in the protruding direction of the protrusion 23, a projected region of the protrusion base portion 43 of the protrusion 23 is located inside a projected opening area of the opening 51 of the hole 31. The embodiment that the projected base portion region is located inside the projected opening region includes the case where the projected opening region and the projected base portion region coincide with each other. The base area S3 of the protrusion base portion 43 on the inner surface 11 of the ground electrode 10E is thus smaller than or equal to the opening area S2 of the hole 31. Further, the protrusion base portion 43 has a radius of curvature of 0.1 to 0.3 mm between the first straight portion 41A and the inner surface 11. As the ground electrode 10E has the above features, it is possible to produce the ground electrode 10E at low cost and attain high ignition performance and durability even though the protrusion 23 is formed by the extrusion process in place of the noble metal tip.

FIG. 8(*b*) shows an illustration of a ground electrode 10F as another embodiment of the ground electrode of the spark plug according to the present invention. The ground electrode 10F has the same features as the ground electrode 6. The spark plug with the ground electrode 10F is basically structurally the same as the spark plug 1, except for the ground electrode structure. The ground electrode 6 and the ground electrode 10 are different from each other in the cross sectional shape of the hole.

As shown in FIG. 8(*a*), the ground electrode 10F has a protrusion 21 and a hole 33 formed by extrusion process. The hole 33 is formed in the same manner as the hole 31, except that the hole 33 has a substantially spherical shape that is circular in cross section perpendicular to the axis direction of the hole 33. Namely, the hole 33 has an opening 51 formed at the outer surface 12 so that, when the hole 33 is projected in the protruding direction of the protrusion 21, the first straight portion 41 of the protrusion 21 is located inside the opening 33 as in the case of the ground electrode 6. As the ground electrode 10F has the above features, it is possible to produce the ground electrode 10F at low cost and attain high ignition performance and durability even though the protrusion 21 is formed by the extrusion process in place of the noble metal tip.

Each of the ground electrodes 10E and 10F has a protruding direction distance B of 0.3 mm or more and a minimum distance C of 0.4 mm or more as in the case of the ground electrode 6. Herein, the minimum distance C of the ground electrode 10F refers to, in a cross section of the ground electrode 10F through the center axis of the spark plug and through the center axis of the ground electrode 10F as shown in FIG. 8(*b*), a distance from the corner of the hole 33 located closest to the protrusion 21, i.e., the corner 56 of the hole 33 on the open edge of the opening 51 to the closest point 62. The ground electrodes 10E and 10F can thus ensure higher ignition performance and durability.

It is also a preferred feature of the spark plug according to the present invention to satisfy the relationship of S4<S1<S2 where S1 is the cross sectional area; S2 is the opening area; and S4 is the projected bottom surface area of the hole as determined when the bottom portion of the hole, the first straight portion and the opening of the hole are projected onto the imaginary plane perpendicular to the protruding direction of the protrusion. Upon satisfaction of this relationship, it is less likely that a crack and poor formation will occur due to the extrusion process so that the ground electrode and the protrusion can ensure higher durability.

The ground electrode 6 of FIG. 2, the ground electrode 7 of FIG. 3, the ground electrodes 6A, 10A and 10B of FIG. 5, the ground electrodes 8 and 9 of FIG. 6 and the ground electrodes 10E and 10F of FIG. 8 are each desired in such a manner that the projected bottom surface area S4 of the hole, the projected first straight portion area S1 and the opening area S2 satisfy the relationship of S4 <S1 <S2. In the ground electrode 6, the projected first straight portion area S1 refers to the cross sectional area of the cross section of the first straight portion 41 perpendicular to the protruding direction of the protrusion 21 as mentioned above. The bottom surface and opening 51 of the hole 31 and the first straight portion 41 share the center axis so that, when projected in the protruding direction of the protrusion 21, the projected areas of the bottom surface and opening 51 of the hole 31 and the first straight portion 41 are coaxial with one another as shown in FIG. 2(*b*) in the ground electrode 6. As each of these ground electrodes 6, 7, 6A, 10A, 10B, 8, 9, 10E and 10F satisfies the above relationship, it is less likely that a crack or poor formation will occur due to the extrusion process so that the ground electrode and the protrusion can ensure higher durability.

It is also a further preferred feature of the spark plug according to the present invention that the ratio (V2/V1) of a volumetric capacity V2 of the hole to a volume V1 of the protrusion is in the range of 1.2 to 2. It is possible to attain higher ignition performance and durability when the volumetric capacity ratio is in the above numerical range.

The ground electrode 6 of FIG. 2, the ground electrode 7 of FIG. 3, the ground electrodes 6A, 10A and 10B of FIG. 5, the ground electrodes 8 and 9 of FIG. 6 and the ground electrodes 10E and 10F of FIG. 8 are each desired in such a manner that the ratio (V2/V1) of the volumetric capacity V2 of the hole to the volume V1 of the protrusion is in the range of 1.2 to 2. Each of these ground electrodes 6, 7, 6A, 10A, 10B, 8, 9, 10E and 10F can ensure higher ignition performance and durability by satisfaction of the above volumetric capacity ratio.

The spark plug according to the present invention can be produced by the following procedure. First, a wire or rod material of Ni-based alloy etc. is prepared by casting and annealing. For example, a molten Ni-based alloy is prepared by a vacuum furnace and formed into a cast ingot by vacuum casting. The cast ingot is formed into a wire or rode material of desired shape and dimensions by hot working and wire drawing etc. A protrusion and a hole are formed by extrusion process on one end portion of the wire or rod material. With this, a ground electrode base body is obtained.

For example, it is feasible to form the ground electrode base body with the protrusion and hole for production of the ground electrode by using a punch for making a desired hole, pressing the punch substantially perpendicularly onto one side of the wire or rod material which is to be the outer surface of the ground electrode 6 and thereby extruding the protrusion for the ground electrode 6 from the other opposite side of the wire or rod material. In order to form the ground electrode base body in the above-mentioned manner, there can be used a technique described in Non-Patent Document 1 and a technique using a known extrusion machine with a punch etc. One example of extrusion machine for suitably forming the ground electrode base body is that including a punch, a plate shaped press die having a through hole through which the punch passes, a receiving die having a recess shaped accommodating portion in which the wire or rod material is accommodated and a thought hole formed in the accommodating portion and adapted such that the press die is placed on an upper surface of the receiving die and a receiving pin inserted in the through hole of the receiving die. In the case of forming the ground electrode base body by means of this extrusion machine, the press die is placed on and fixed to the upper surface of the receiving die, with the wire or rod material being accommodated in the accommodating portion. The punch is then pressed onto the wire or rod material through the through hole of the press die, thereby extruding the protrusion for the ground electrode 6 from through the through hole of the receiving die while receiving the protrusion by the receiving pin. At this time, the shape and dimensions of the hole can be adjusted by controlling the shape and dimensions of the punch. The shape and dimensions of the protrusion can be also adjusted by controlling the shape and dimensions of the through hole of the receiving die and/or the shape and dimensions of the receiving pin. In this way, it is preferable to extrude the protrusion by arranging the receiving pin etc. under the wire or rod material in such a manner that the receiving pin faces the punch with some distance left therebetween so as to receive and retain thereon the protrusion extruded from the wire or rod material. Subsequently, the other end portion of the ground electrode base body is joined by welding etc. to the end of the metal shell 4 that has been formed into a desired shape by plastic working process.

The center electrode 2 is formed by molding a column shaped inner electrode member 2B and a cup shaped outer electrode member 2A from the above-mentioned materials, respectively, inserting the inner electrode member 2B into the outer electrode member 2A and subjecting these electrode members to plastic working process such as extrusion process. The ceramic insulator 3 is formed by sintering a ceramic material into a given shape. The center electrode 2 is then fixed into the insulator 3 by any known technique. The resulting subassembly of the insulator 3 is fixed to the metal shell 4 with the ground electrode base body joined thereto. Subsequently, the ground electrode 6 is completed by bending the front end portion of the ground electrode base body toward the center electrode 2 in such a manner that the protrusion faces the front end of the center electrode 2. In this way, the spark plug according to the present invention can produced.

The spark plug according to the present invention is used as an ignition plug of an internal combustion engine such as a gasoline engine and is fixed to a given position on a cylinder head (not shown) of the internal combustion engine, which defines therein a combustion chamber in the engine), by screw engagement of the thread portion 5 in a screw hole of the cylinder head. The spark plug according to the present invention can be applied to any types of internal combustion engines and, in particular, can suitably be used in low-cost internal combustion engines and high-performance-ignition internal combustion engines.

In the present invention, the spark plug may have a noble metal tip fixed to the front end of the center electrode. This noble metal tip is generally formed into a column shape with appropriately adjusted dimensions and is fused to the center electrode by any adequate welding technique such as laser welding or electrical resistance welding. As a material of the noble metal tip, there can be used noble metals such as Pt, Pt alloy, Ir and Ir alloy.

EXAMPLES

Example 1

Figure 9:
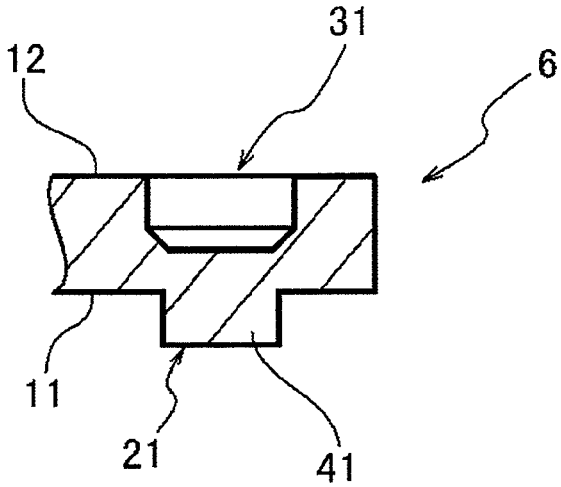
FIG. 9 is an enlarged section view of a front end portion of a ground electrode of a spark plug.
Figure 9:
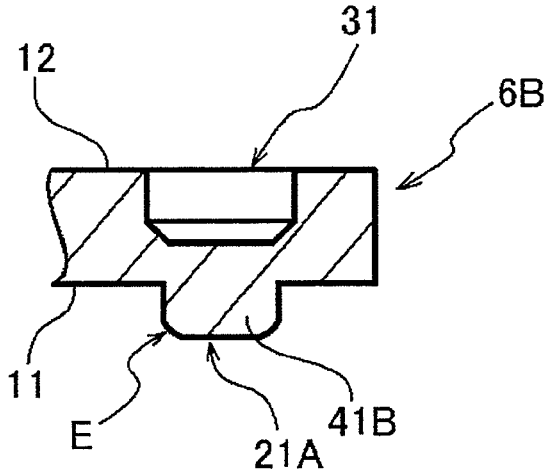

A molten Ni-based alloy was prepared by an ordinary vacuum furnace and formed into a cast ingot by vacuum casting. The cast ingot was subjected to hot working and wire drawing, thereby obtaining a rectangular column shaped wire material with cross sectional dimensions of 1.3×2.7 (mm). Subsequently, one end portion of the wire material was extruded by a circular column shaped punch so as to form a circular column shaped protrusion 21 and a bottomed, circular cylindrical shaped hole 31 on the one end portion of the wire material as shown in FIG. 9(*a*). With this, a ground electrode base body was produced. The ground electrode base body was herein adjusted in such a manner that the distance between the part of the inner surface on which the protrusion was not formed and the part of the outer surface in which the hole was not formed (sometimes referred to as "outer thickness") was 1.5 mm and the volumetric capacity of the hole was 2.9 $cm^3$.

Next, a circular column shaped inner electrode member 2B and a cup shaped outer electrode member 2A were formed of copper and Ni-alloy, respectively. The inner electrode member 2B was inserted into the outer electrode member 2A. Then, the inner and outer electrode members 2B and 2A were subjected to plastic working process such as extrusion process, thereby obtaining a center electrode 2 with a diameter of 4 mm. A metal shell 4 of low carbon steel was also formed into a desired shape and dimensions by plastic working process. The ground electrode base body was joined at the other end portion thereof to an end face of the metal shell 4. Further, an insulator 3 was formed by sintering an alumina-based ceramic material into a given shape. The center electrode 2 was fixed into the insulator 3. The resulting subassembly of the insulator 3 was fixed to the metal shell 4 with the ground electrode base body joined thereto. Subsequently, a ground electrode 6 was completed by bending the front end portion of the ground electrode base body toward the center electrode 2 in such a manner that the protrusion faced a front end of the center electrode 2. Samples of spark plugs were produced in the same manner as above.

Figure 10:
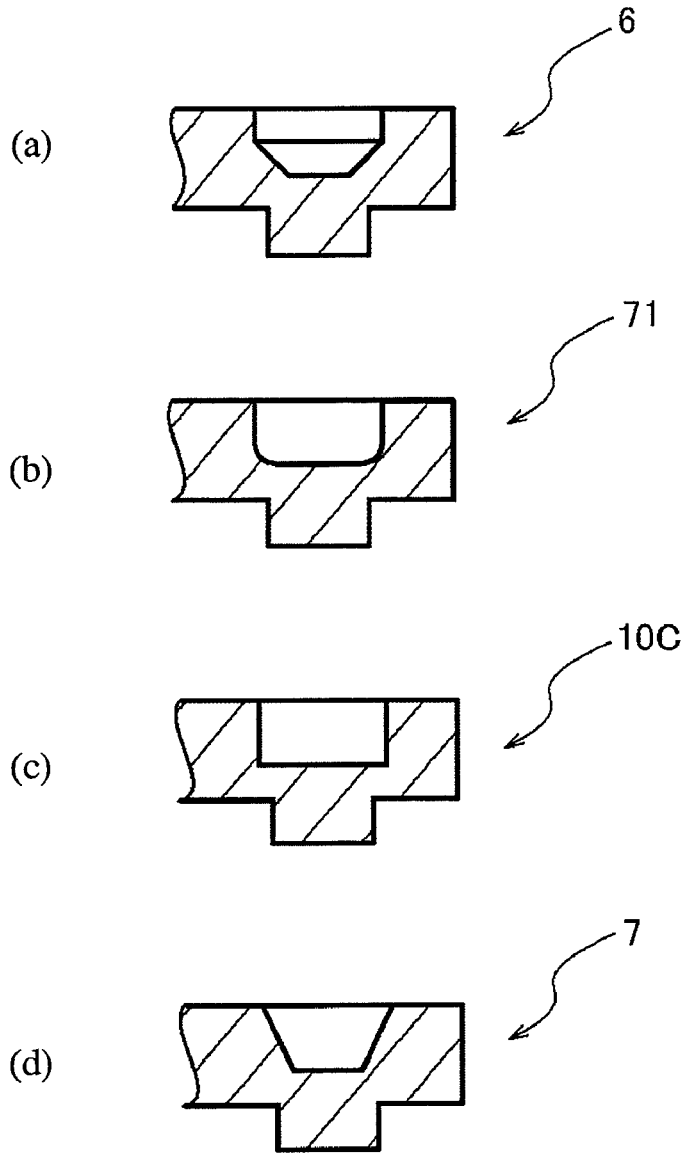
FIG. 10 is an enlarged section view of a front end portion of a ground electrode of a spark plug.

The forms of ground electrodes of the above-produced spark plugs are shown in FIG. 10(*a*) to (*d*). A ground electrode 6 shown in FIG. 10(*a*) was the same as the ground electrode 6 shown in FIG. 2(*a*). A ground electrode 71 shown in FIG. 10(*b*) was of the type where the taper portion of the ground electrode 6 was modified into a curved surface design. A ground electrode 10C shown in FIG. 10(*c*) was the same as the ground electrode 6, except that no tapered portion was formed on the hole of the ground electrode. A ground electrode 71 shown in FIG. 10(*d*) was the same as the ground electrode 71 shown in FIG. 3(*b*).

[Judgment on Protrusion Formation]

A judgment was made on whether the protrusion was accurately formed. It was herein judged that the protrusion was not accurately formed and thus was low in dimensional accuracy when the curvature radius R of a peripheral edge portion of the front end face of the protrusion was R≧0.05. More specifically, it was judged that the formation of the protrusion was not accurate when there was no edge on a peripheral edge portion E of the front end face of the protrusion 21A, i.e., on a region E of intersection of the outer circumference of the first straight portion 41B and the front end face of the protrusion 21A in the case of the ground electrode 6B of FIG. 9(*b*). Herein, the curvature radius R of the peripheral edge was measured by means of a projector. The judgment results are shown in TABLE 1. In TABLE 1, the symbol "X" indicates that the sample met the condition of R≧0.5; and the symbol "○" indicates that the sample did not met the condition of R≧0.5.

[Crack Occurrence Rate]

Twenty samples of each type of the spark plugs were visually checked to examine the presence of a crack in the vicinity of the protrusion of the ground electrode and in the bottom of the hole of the ground electrode. It was judged that the crack occurred when there was at least one crack in any of the twenty samples of the spark plug. The judgment results are shown in TABLE 1. In TABLE 1, the symbol "X" indicates that the crack occurred in any of the samples; the symbol "○" indicates that no crack occurred in the samples.

[Heating Vibration Test]

Among the produced spark plugs, the spark plugs of the types shown in FIG. 10(*a*) to (*c*) were each tested for the durability to heat and vibration. The sample was herein so designed that: the outer size of the sample was 1.5 mm×2.8 mm; the hole was circular in plan view and formed with a depth of 1 mm and a diameter of 1.7 mm; and the protrusion was circular in plan view and formed with a diameter of 1.5 mm and a protruding length of 0.7 mm. In the ground electrode 6 of FIG. 10(*a*), each of the distance a and distance b of the taper portion as defined in FIG. 4 and explanation thereof was 0.1 mm. Further, the curvature radius of the curved surface of the hole was 0.1 mm in the ground electrode 71 of FIG. 10(*b*). The test procedure was as follows. Each of the spark plug samples was mounted to a jig and vibrated while being heated by a burner. The sample was maintained under the vibration conditions of a vibration width of 5 mm, a vibration frequency of 40 Hz, an acceleration of 28 G and an outside environmental temperature of 1000° C. After that, the state of the sample was visually checked. The test results are shown in TABLE 1. In TABLE 1, the symbol "○" indicates that there was no appearance defect; the symbol "Δ" indicates that the crack occurred in the vicinity of the hole and in the bottom of the hole; and the symbol "X" indicates that the breakage occurred in the vicinity of the front end portion of the ground electrode substantially in parallel with the center hole of the hole.

TABLE 1

| Sample | Protrusion | Crack Occurrence | Durability |
|---|---|---|---|
| a | ○ | ○ | ○ |
| b | ○ | ○ | Δ |
| c | ○ | X | X |
| d | X | ○ | — |

As shown in TABLE 1, the occurrence of the crack and breakage was prevented when the hole had both of the second straight portion and the taper portion. It is possible to avoid dielectric breakdown and, as a result, possible to secure durability of the spark plug by preventing the occurrence of the crack and breakage. When the taper portion was provided on the whole of the circumferential surface of the hole, it was difficult to form the protrusion accurately so that the dimensional accuracy of the protrusion was deteriorated. It is possible that the spark plug having the protrusion of high dimensional accuracy can attain good ignition performance due to less interference of the generation of the spark discharge with the protrusion.

Example 2

Spark plugs were produced in the same manner as in Example 1. Herein, there were produced two kinds of samples of the spark plugs; one of which had a ground electrode 6 where the protrusion 21 was circular in cross section perpendicular to the axis direction thereof as shown in FIG. 5(*a*) and the other of which had a ground electrode 10A where the protrusion 26A was rectangular in cross section perpendicular to the axis direction thereof so that edges were formed on the surface of the first straight portion of the protrusion as shown in FIG. 5(*c*).

[Breakdown Voltage]

Figure 11:
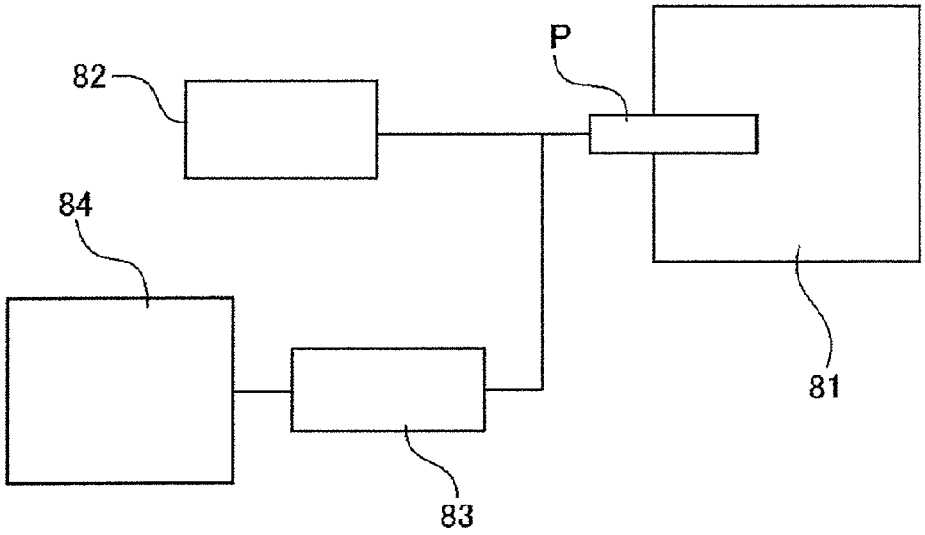
FIG. 11 is a schematic view of an apparatus for measuring the breakdown voltage of a spark plug in Example 2.

The breakdown voltage of the ground electrodes 6 and 10A was measured by means of a measurement apparatus of FIG. 11. In the measurement apparatus of FIG. 11, one end portion of the spark plug P on which the ground electrode was located was inserted and sealed in a chamber 81; and the other end portion of the spark plug P was connected to an ignition coil 82. Further, a voltage probe 83 (manufactured by Tektronix Japan, Ltd.) and an oscilloscope (manufactured by Tektronix Japan, Ltd.) were connected to the spark plug so as to measure the voltage on the spark plug. The dimensions of the spark plug samples were herein so designed that: the spark gap G was 1.1 mm; the protrusion length A of the protrusion was 0.7 mm; and the area of the front end face of the protrusion was 1.7 $mm^2$.

Figure 12:
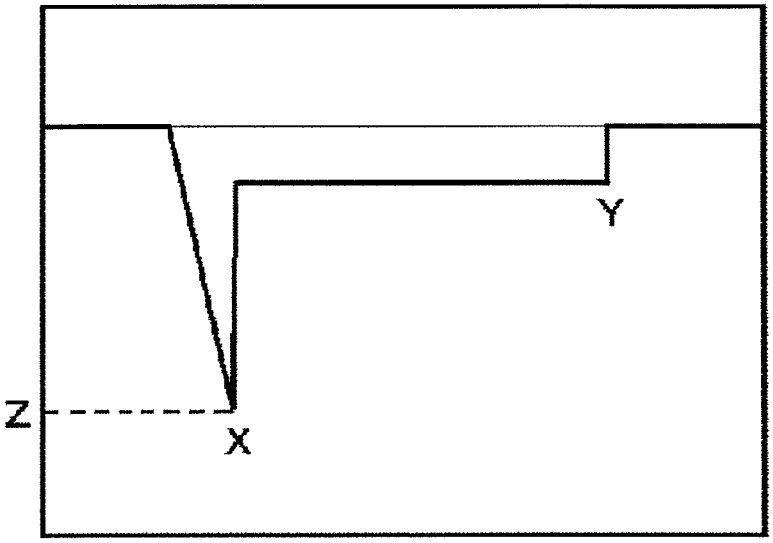
FIG. 12 is a diagram showing a waveform measured by an oscilloscope in Example 2.
Figure 13:
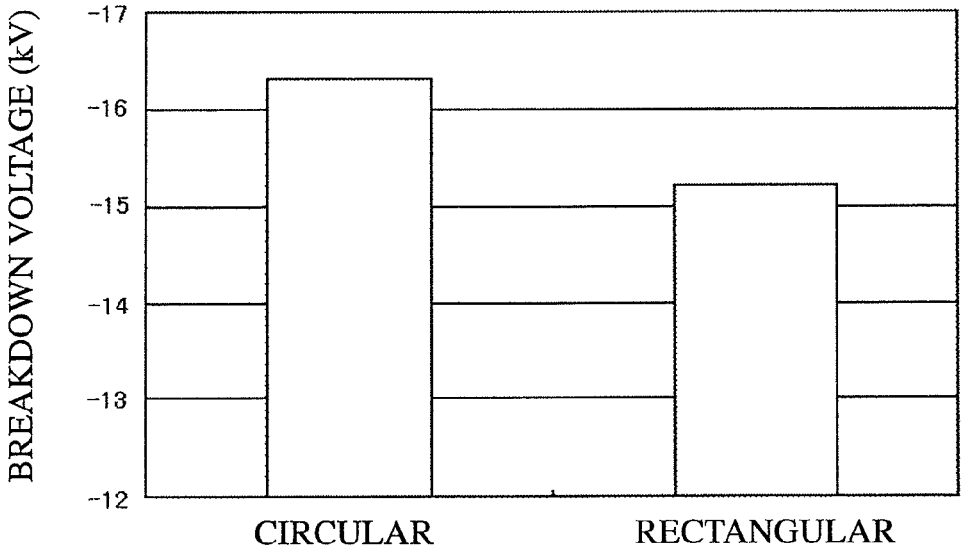
FIG. 13 is a graph showing the breakdown voltage measurement results of Example 2.

FIG. 12 shows a waveform measured by the oscilloscope 84. In FIG. 12, the point of significant drop of the measurement value corresponds to a discharge start point X at which the spark discharge started in the chamber 81; the point of return of the measurement value to its reference value corresponds to a discharge end point Y at which the spark discharge ended in the chamber 81. The breakdown voltage was determined as the voltage Z of the spark plug at the discharge start point X in the waveform of the oscilloscope 82 shown in FIG. 12. FIG. 13 shows the breakdown voltage measurement results in graph form. In FIG. 13, the term "circular" means that the protrusion of the ground electrode 6 was circular; and the term "rectangular" means that the protrusion of the ground electrode 10A was rectangular.

As is apparent from FIG. 13 the round electrode 10A where the edges are formed on the surface of the first straight portion of the protrusion had a relatively low breakdown voltage in comparison to that of the ground electrode 6. It is thus possible to decrease the amount of consumption of the electrode and decrease the possibility of perforation through the insulator by spark discharges by reducing the breakdown voltage of the spark plug.

Example 3

Figure 14:
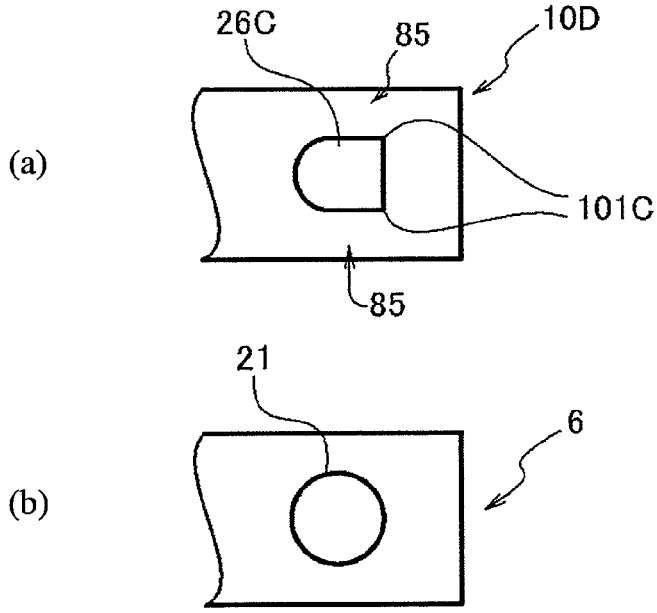
FIG. 14 is an enlarged view of a protrusion of a spark plug used as a test sample in Example 3.

Spark plugs were produced in the same manner as in Example 1. Herein, there were produced two kinds of samples of the spark plugs; one of which had a ground electrode 10D where there were formed a curved surface on the side of the protrusion 26C closer to the rear end of the ground electrode and two edges 101C and 101D on the side of the protrusion 26C closer to the front protruding end of the ground electrode as shown in FIG. 14(*a*) and the other of which had a ground electrode 6 where the protrusion 21 was circular in cross section perpendicular to the axis direction thereof as shown in FIG. 14(*b*). The samples of the spark plugs were designed so that the area of the front end face of the protrusion was 1.5 $mm^2$.

[Ignition Performance Test]

Figure 15:
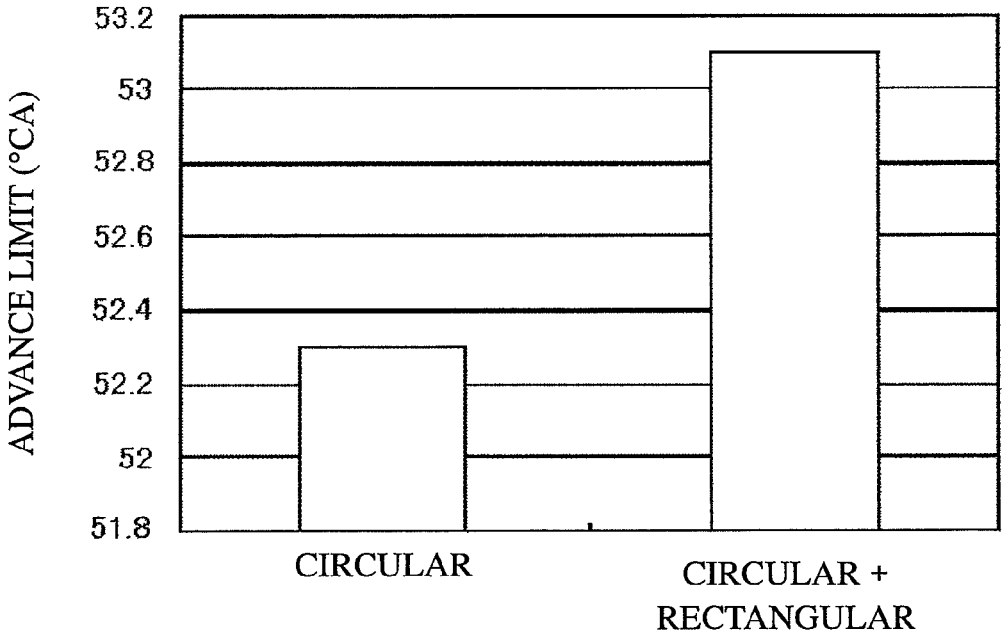
FIG. 15 is a graph showing the ignition performance test results of Example 3.

Each of the above-produced spark plugs was tested by mounting the spark plug on a six-cylinder, 2000-cc gasoline engine and starting and idling the engine under the conditions of an intake pressure of −550 mmHg, a speed of 750 rpm and an air/fuel ratio (A/F) of 14.5. During the idling, an indicate mean effective pressure was determined from the combustion pressure of the engine. A combustion fluctuation rate was calculated from an average value and a standard deviation of 500 determination results of the indicate mean effective pressure according to the following formula: combustion fluctuation rate=(standard deviation/average value)×100(%). The ignition timing of the engine at a combustion fluctuation rate of 20% was then determined as Advance Limit (°CA). FIG. 15 shows the determination results in graph form. In FIG. 15, the term "circular+rectangular" means that the spark plug had the ground electrode 10D of FIG. 14(*a*); and the term "circular" means that the spark plug had the ground electrode 6 of FIG. 14(*b*). The larger the value of Advance Limit (°CA), the higher the ignition performance of the spark plug.

As shown in FIG. 15, in comparison to the case where only the curved surface was formed on the outer circumference of the protrusion, in the case where there were formed the curved surface on the outer circumference of the protrusion and the edges on the side of the protrusion closer to the front end of the ground electrode, the spark discharge can be easily generated on the side of the protrusion closer to the front end of the ground electrode. It is possible to improve the ignition performance of the spark plug as there is less obstacle to flame growth when the spark discharge occurs on the side of the protrusion closer to the front end of the ground electrode.

Example 4

Figure 16:
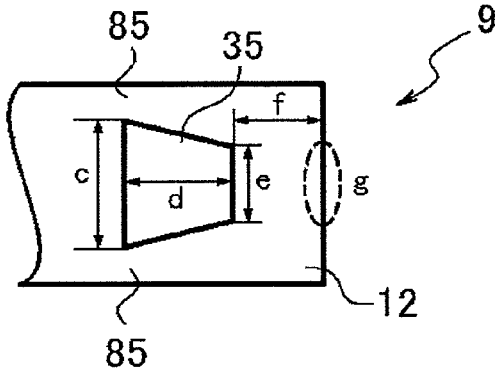
FIG. 16 is a schematic view of a ground electrode used as a test sample in Example 4.

Spark plugs were produced in the same manner as in Example 1. Herein, there were produced two kinds of samples of the spark plugs; one of which had a ground electrode 8 of FIG. 6 and the other of which had a ground electrode 9 of FIG. 6. As shown in FIG. 16, the respective dimensions c, d, e and f of the hole 35 of the ground electrode 9 shown in FIG. 6 were adjusted as follows: c=1.7 mm, d=1.7 mm, e=1.5 mm and f=1 mm. The respective dimensions of the hole 35 of the ground electrode 8 were the same as those of the ground electrode 9 except that the values of the dimensions c and f were interchanged. Further, each of the ground electrodes 8 and 9 had a protrusion that was rectangular in plan view and formed with dimensions of 1.3 mm×1.3 mm and a protrusion length of 0.7 mm although not shown in FIG. 16.

[Heating Test]

Each of the spark plugs was tested for the difference in temperature rise during heating of the ground electrode depending on the position of the smallest thickness regions. The test was conducted by mounting the spark plug to a water-cooled chamber and heating the ground electrode 9 with a burner for about 5 minutes until the temperature of a measurement region g of the ground electrode 9 shown in FIG. 16 was stabilized at 1000° C. The temperature of a measurement region g of the ground electrode 8 was also measured by heating the ground electrode 8 under the same heating conditions.

As seen from the temperature measurements, the ground electrode 9 reached a temperature of 1000° C. whereas the ground electrode 8 reached a temperature of only 980° C. In other words, the temperature of the ground electrode was more difficult to rise when the smallest thickness regions were located on the front end side of the ground electrode than on the rear end side of the ground electrode. It has been shown that it is possible to prevent the ground electrode from thermal deterioration and thereby possible to secure the heat resistance of the spark plug.

Although there were smallest thickness regions between closest parts of the contours of the hole and of the outer surface in each of the ground electrode 10D of FIG. 14(*a*) and the ground electrode 6 of FIG. 14(*b*), heat was more likely to transfer from the front end to the rear end of the ground electrode 10D. Even if the smallest thickness regions of the ground electrodes 10D and 6 had the same dimensions, the smallest thickness regions of the ground electrode 6 interfered with the transfer of heat from the front end to the rear end of the ground electrode; whereas the smallest thickness regions of the ground electrode 10D were formed in parallel with the direction of heat flow and thus were unlikely to interfere with the transfer of heat from the front end to the rear end of the ground electrode.

Example 5

Ground electrode base bodies each having a protrusion and a hole shaped as shown in FIG. 2 were produced by conducting extrusion process basically in the same manner as in Example 1. Using these ground electrode base bodies, a plurality of samples of spark plugs were produced in the same manner as in Example 1 in such a manner that the above-mentioned protruding direction length B was 0.3 mm or more and the above-mentioned minimum distance C was 0.4 mm or more in each of the spark plugs.

[Thermal Cycle Resistance Test]

Each of the produced spark plugs where no crack was present was mounted on a a six-cylinder, 2000-cc gasoline engine and subjected to thermal cycle for 1 hour by alternately repeating operation of the engine at 5000 rpm for 1 minute and idling of the engine for 1 minute. After that, the spark plug was detached from the gasoline engine and visually checked to examine the presence of a crack in the vicinity of the protrusion of the ground electrode. The rate of occurrence of the crack was determined according to the following formula: crack occurrence rate=(number of samples cracked/number of samples)×100(%). The determination results are shown in FIG. 17.

Figure 17:
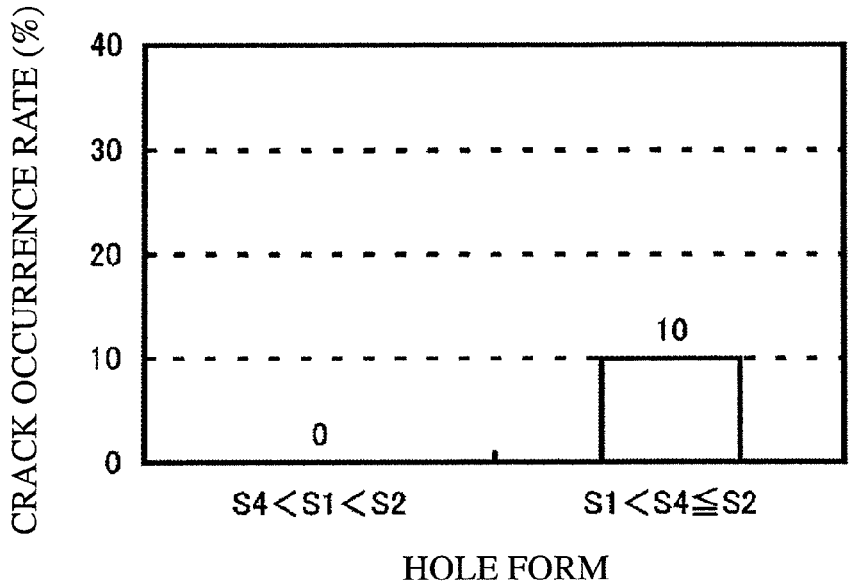
FIG. 17 is a graph showing the crack occurrence rate test results of Example 5.

As shown in FIG. 17, no crack occurred in the ground electrode during the above accelerated test when the projected bottom surface area S4 of the hole, the projected area S1 of the first straight portion and the projected area S2 of the opening satisfied the relationship of S4<S1<S2. It has thus been shown that it is possible that the ground electrode can attain higher resistance by satisfaction of the relationship of S4<S1<S2.

The following are reference examples for comparison of one embodiment of the spark plug according to the present invention, in which the ground electrode is bent to define a spark gap between the front end of the center electrode and the inner surface of the ground electrode facing the center electrode and satisfies the following features that: the ground electrode has a protrusion and a hole formed by extrusion process on a front end portion thereof; the protrusion protrudes from the inner surface toward the front end of the center electrode by a protruding length A of 0.4 to 1 mm from the inner surface and includes a first straight portion formed in such a manner that a width of the protrusion in a cross section through a center axis of the protrusion is uniform along a center axis direction of the protrusion and that the first straight portion has a projected first straight portion area S1 of 1.5 to 3 $mm^2$ where the projected first straight portion area S1 is a projected area of the first straight portion on a plane perpendicular to the center axis of the protrusion; and the hole has an opening formed at an outer surface of the ground electrode opposite the inner surface in such a manner that a contour of the first straight portion of the protrusion projected onto an imaginary plane perpendicular to the protruding direction of the protrusion is located inside of a contour of the opening projected on said imaginary plane and that a ratio (S2/S1) of a projected opening area S2 of the opening to the projected first straight portion area S1 is not less than 1.2, with the prior art.

Reference Example 1 and Reference Comparative Example 1

Figure 18:
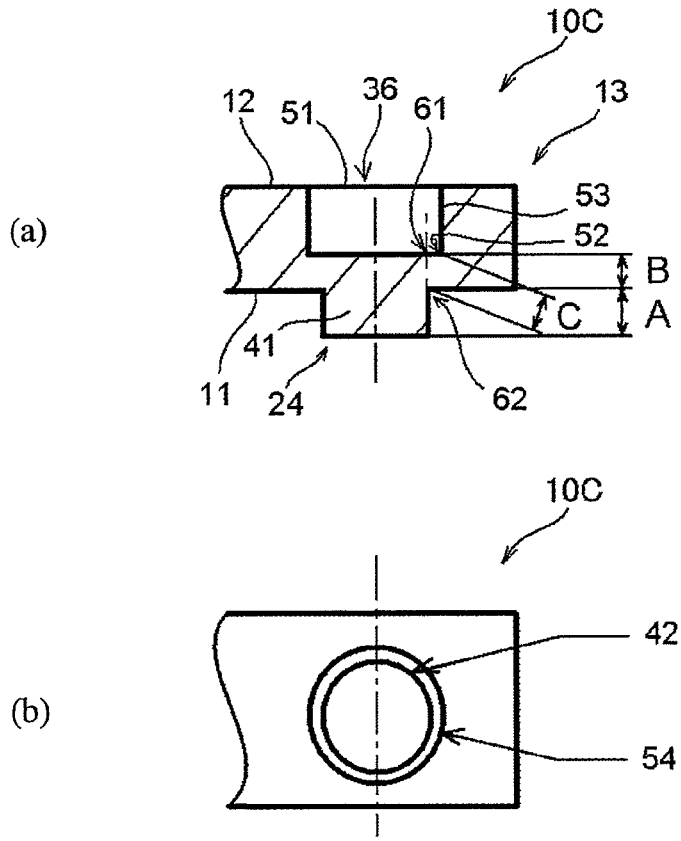
FIG. 18 is an enlarged view of a front end portion of a ground electrode of a spark plug, wherein FIG. 18(*a*) is an enlarged section view of the front end portion of the ground electrode of the spark plug.

A molten Ni-based alloy was prepared by an ordinary vacuum furnace and formed into a cast ingot by vacuum casting. The cast ingot was subjected to hot working and wire drawing, thereby obtaining a rectangular column shaped wire material with cross sectional dimensions of 1.3 ×2.7 (mm). Subsequently, one end portion of the wire material was extruded by a circular column shaped punch so as to form a circular column shaped protrusion and a bottomed, circular cylindrical shaped hole on the one end portion of the wire material as shown in FIG. 18. In this way, samples of ground electrode base bodies were produced. The protruding length A and projected first straight portion area S1 of the protrusion and the area ratio (S2/S1) of the protrusion and hole were herein controlled to the values shown in FIG. 19. More specifically, the projected first straight portion area S1 of the protrusion was adjusted to 1.3, 1.5, 2.5, 3.0 or 3.5 $mm^2$; the protruding length A of the protrusion was adjusted to 0.2, 0.3, 0.4, 0.7, 0.8, 1.0 or 1.2 mm; and the area ratio (S2/S1) of the protrusion and hole was adjusted to 0.9, 1.0, 1.1, 1.2 or 1.3.

Next, a circular column shaped inner electrode member 2B and a cup shaped outer electrode member 2A were formed of copper and Ni-alloy, respectively, as shown in 18(*b*). The inner electrode member 2B was inserted into the outer electrode member 2A. Then, the inner and outer electrode members 2B and 2A were subjected to plastic working process such as extrusion process, thereby obtaining a center electrode 2 with a diameter of 4 mm. A metal shell 4 of low carbon steel was also formed into a desired shape and dimensions by plastic working process. The ground electrode base body was joined at the other end portion thereof to an end face of the metal shell 4. Further, an insulator 3 was formed by sintering an alumina-based ceramic material into a given shape. The center electrode 2 was fixed into the insulator 3. The resulting subassembly of the insulator 3 was fixed to the metal shell 4 with the ground electrode base body joined thereto. Subsequently, a ground electrode 10C was completed by bending the front end portion of the ground electrode base body toward the center electrode 2 in such a manner that the protrusion faced a front end of the center electrode 2. Samples of spark plugs were produced in the same manner as above. The ground electrode 10C of FIG. 18 was structurally the same as the ground electrode 6 except of the hole 36.

[Ignition Performance Test]

Figure 19:
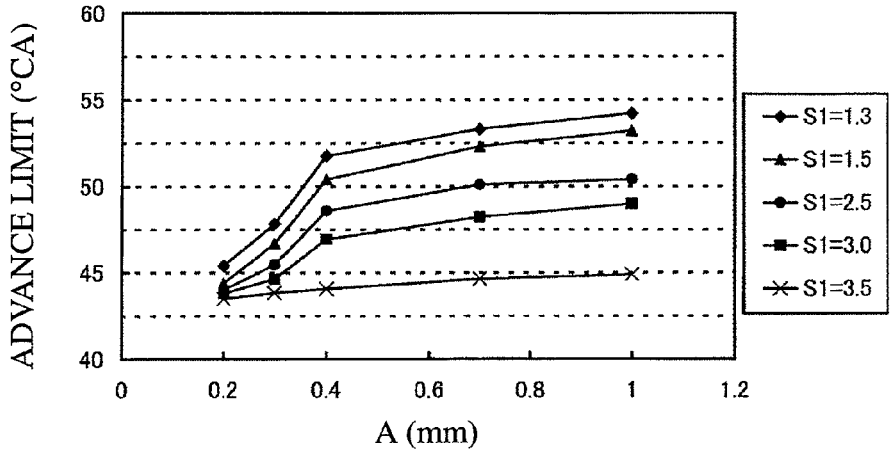
FIG. 19 is a graph showing the ignition performance test results of Reference Example 1 and of Reference Comparative Example 1.

Each of the spark plugs was tested for the ignition performance in the same manner as above. FIG. 19 shows the test results by projected first straight portion area S1.

[Spark Wear Resistance Test]

Figure 20:
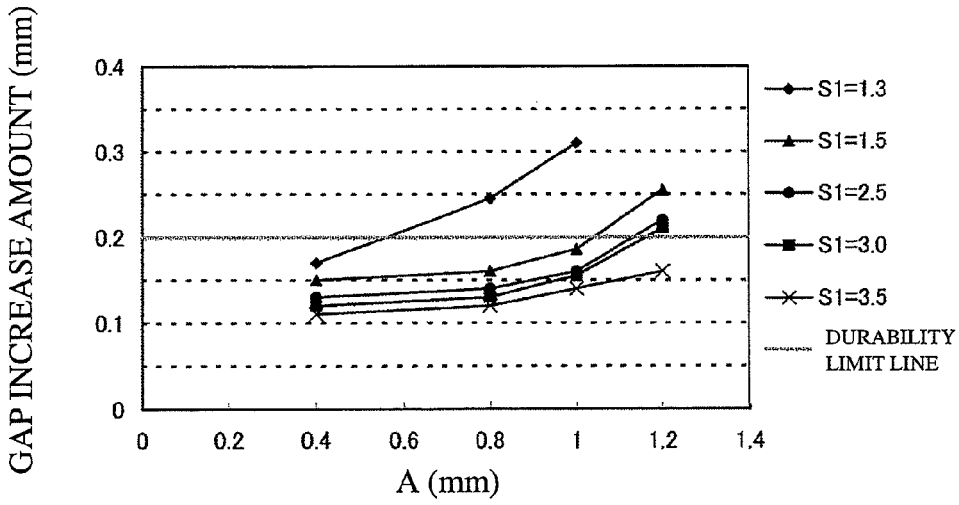
FIG. 20 is a graph showing the spark wear amount test results of Reference Example 1 and of Reference Comparative Example 1.

Each of the spark plugs was tested by mounting the spark plug on a six-cylinder, 2000-cc gasoline engine and operating the gasoline engine at full throttle and at an engine revolution speed of 5000 rpm. After that, the spark plug was detached from the gasoline engine. The amount of increase of the spark gap (referred to as "gap increase amount") of the spark plug was measured. FIG. 20 shows the measurement results by projected first straight portion area S1 .

[Crack Occurrence Rate]

Figure 21:
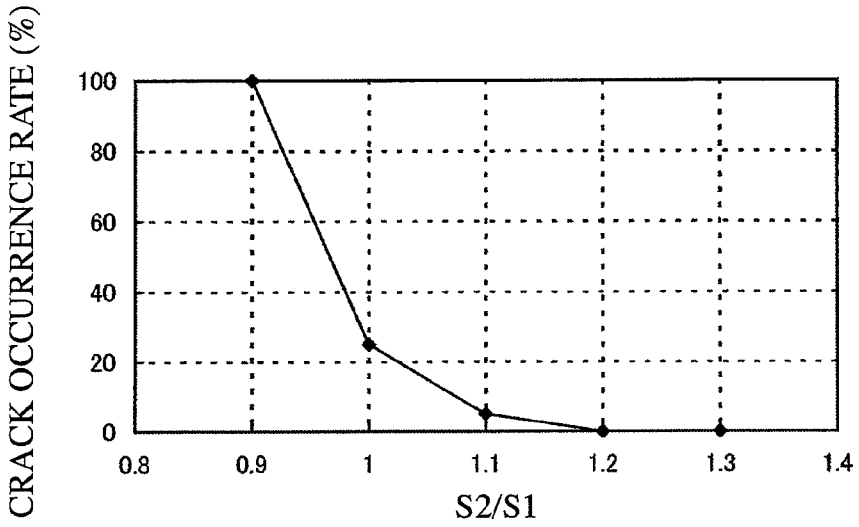
FIG. 21 is a graph showing the crack occurrence rate test results of Reference Example 1 and of Reference Comparative Example 1.

Twenty samples of each type of the spark plugs were visually checked to examine the presence of a crack in the vicinity of the protrusion of the ground electrode. The rate of occurrence of the crack was determined for each area ratio (S2/S1) according to the following formula: crack occurrence rate= (number of cracks/20)×100(%). FIG. 21 shows the determination results by area ratio (S2/S1). There was a case where the protrusion was chipped when the area ratio (S2/S1) was less than 1.2.

It has been shown in FIGS. 19 to 21 that, even in the case where the ground electrode of the ground electrode is formed by extrusion of conventional Ni-based alloy, the spark plug can secure compatibility between ignition performance and durability as long as the ground electrode of the spark plug has the above features.

Reference Example 2

Ground electrode base bodies, 10 samples for each type, were produced by forming a protrusion and a hole by a punch on each of the ground electrode base bodies as shown in FIG. 18 while varying the amount of extrusion of the punch during extrusion process. In the produced ground electrode base bodies, the protruding length A, the projected first straight portion area S1 and the area ratio (S2/S1) were controlled to within the ranges of the present invention; the protruding direction distance B was controlled to 0.2, 0.3, 0.4 or 0.5 mm; and the minimum distance C was controlled to 0.2, 0.3, 0.35 or 0.4 mm. Using these ground electrode members, spark plugs, 10 samples for each type, were produced in the same manner as in Reference Example 1.

Each of the produced spark plugs was visually checked to examine the presence of a crack in the vicinity of the protrusion of the ground electrode. The rate of occurrence of the crack was determined for each type of the spark plug according to the following formula: crack occurrence rate=(number of cracks/10)×100(%). FIG. 21 shows the determination results by minimum distance C.

Figure 22:
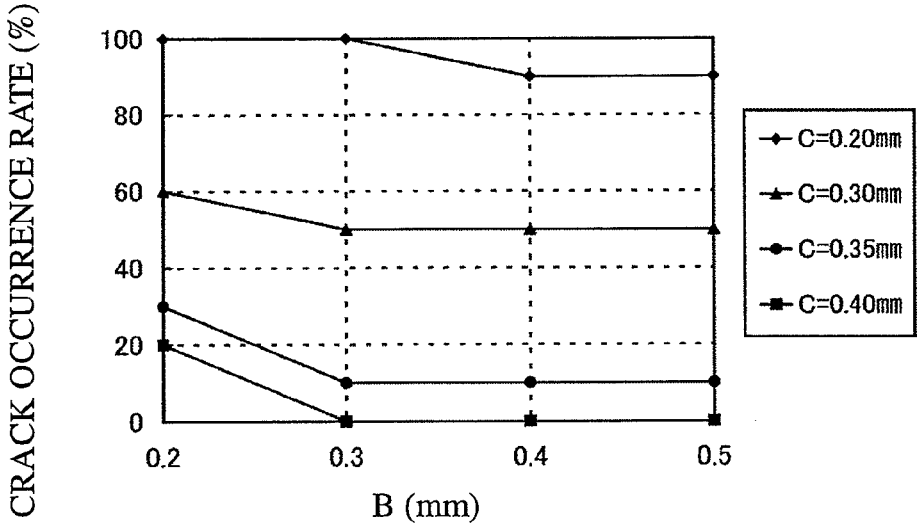
FIG. 22 is a graph showing the crack occurrence rate test results of Reference Example 2.

It has been shown in FIG. 22 that it is possible to further reduce the rate (%) of occurrence of the crack in the ground electrode so that the ground electrode can higher durability by controlling the protruding length distance B and the minimum distance C of the ground electrode to within the above specific ranges.

Reference Example 3

Ground electrode base bodies were produced in the same manner as in Reference Example 1 with different volume ratio (V2/V1) by varying the opening area S2, the projected first straight portion area S1 and the protruding length A and thereby adjusting the volumetric capacity of the hole and the volume of the protrusion. Each of the produced ground electrode base bodies was visually checked to examine the form of the tip end portion of the protrusion and the occurrence of a crack in the vicinity of the protrusion. As a result, there was a case where a curved surface was formed with a radius of curvature of 0.05 mm or more on or around the tip end of the protrusion when the volume ratio (V2/V1) was less than 1.2. It is assumed that the spark plug with such a curved surface on or around the tip end of the protrusion would have a spark discharge voltage slightly higher than that of the spark plug with no curved surface on the ground electrode. On the other hand, there was a case where a minute crack occurred in the vicinity of the protrusion due to slight deformation in the front end side of the ground electrode base body, rather than in the protrusion, when the volume ratio (V2/V1) exceeded 2.0. It is assumed that the spark electrode with such a minute crack in the ground electrode would be slightly lower in durability than the spark plug with no crack in the ground electrode. It thus has been shown that it is possible that the spark plug can attain higher ignition performance and durability when the volume ratio (V2/V1) of the ground electrode of the spark plug falls within the above specified range.

Figure 23:
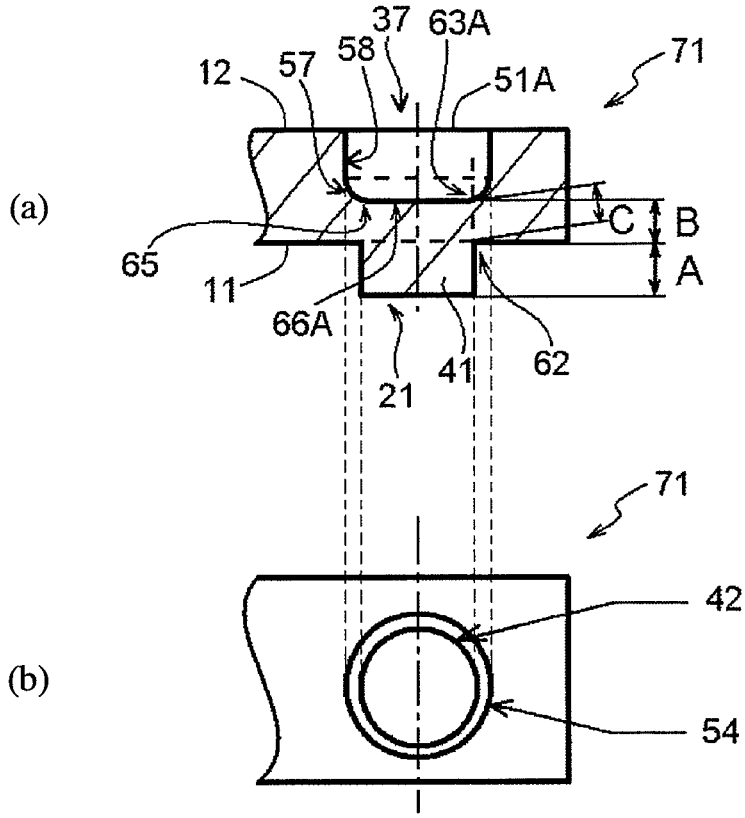
FIG. 23 is an enlarged view of part of the ground electrode shown in FIG. 10(*b*), wherein FIG. 23(*a*) is an enlarged section view of the front end portion of the ground electrode.

As another reference example, a ground electrode 71 of FIG. 10(*b*) will be described below with reference to FIG. 23. The ground electrode 71 and the ground electrode 6 are different from each other in the form of the transition portion. As shown in FIG. 2(*a*), the transition portion 67 of the ground electrode 6 is in the form of the taper portion 55. By contrast, the transition portion of the ground electrode 71 is in the form of a curved surface portion as shown in FIG. 23. As the ground electrode 71 is structurally similar to the ground electrode 6 except for having a hole 37 with a curved surface portion 57, the same reference numerals are used for the same parts and portions in the drawing; and detailed explanations of the protrusion 21 etc. of the ground electrode 71 designated by the same reference numerals as those of the ground electrode 6 may be omitted.

The curved surface portion 57 of the ground electrode 71 refers to, in an a cross section through the center axis of the hole 37, a region that has curved contours extending between the contours of the second straight portion 58 and of the bottom portion 66A. Further, the projected first straight portion region 42 is located inside the projected opening region 54. It is thus less likely that a crack and poor formation will occur in the ground electrode 71 due to extrusion process during the manufacturing stage and is possible that the ground electrode 71 can secure high ignition performance and durability.

Figure 24:
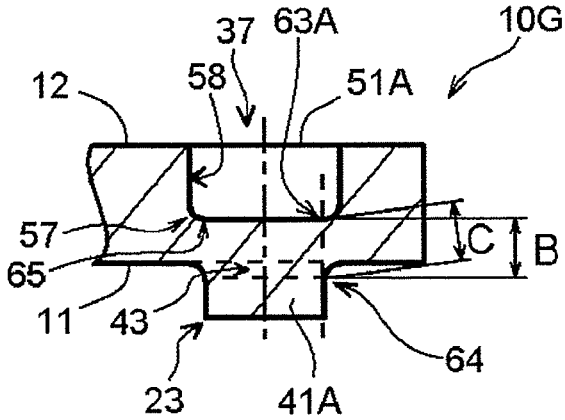
FIG. 24 is an enlarged section view of a front end portion of a ground electrode of a spark plug.

As still another reference example, a ground electrode 10G is shown in FIG. 24. The ground electrode 10G has a hole 37 and a protrusion 23 with a protrusion base portion 43. The hole 37 of the ground electrode 10G is the same as that of the ground electrode 10E of FIG. 23; and the protrusion 23 and protrusion base portion 43 are the same as those of the ground electrode 10E of FIG. 8(*a*). Thus, the protrusion base portion 43 is formed with a radius of curvature of 0.1 to 0.3 mm between the first straight portion 41A and the inner surface 11 as mentioned above. As the ground electrode 10G has the above characteristic features, it is possible that the spark plug can be produced at low cost and attain high ignition performance and durability by the use of this ground electrode 10G.

As in the case of the ground electrode 6, the ground electrodes 71 and 10G has a protruding length A of 0.4 to 1 mm and a projected first straight portion area S1 of 1.5 to 3 $mm^2$ and are formed in such a manner that the area ratio (S2/S1) of the projected opening area S2 of the opening 51 to the projected first straight portion area S1 is 1.2 or more. The ground electrodes 71 and 10G also have a distance B of 0.3 mm or more and a distance C of 0.4 mm or more. Further, the ground electrodes 71 and 10G are formed in such a manner that: the projected bottom surface area S4 of the protrusion 37, the projected first straight portion area S2 and the projected opening area S2 satisfy the relationship of S4<S1<S2; and that the ratio (V2/V1) of the volumetric capacity V2 of the hole 37 to the volume V1 of the protrusion is in the range of 1.2 to 2. As each of the ground electrodes 71 and 10G has the above features, it is possible that the spark plug can attain higher ignition performance and durability by the use of the ground electrode 71, 10G as in the case of Reference Examples 1 to 3 mentioned above in comparison to conventional spark plugs.

DESCRIPTION OF REFERENCE NUMERALS

1: Spark plug
2: Center electrode
2A: Outer electrode member
2B: Inner electrode member
3: Insulator
4: Metal shell
5: Threaded portion
6, 6A, 6B, 7, 71, 8, 9, 10A, 10B, 10C, 10D, 10E, 10F, 10G: Ground electrode
11: Inner surface
12: Outer surface
13: Front end portion
21, 21A, 22, 23, 24, 25, 26, 26A, 26B, 26C: Protrusion
21, 32, 33, 34, 35, 36, 37: Hole
41, 41A, 41B: First straight portion
42: Projected first straight portion area
43: Protrusion base portion
51, 51A: Opening
52, 56, 65: Edge
53, 58: Second straight portion
54: Projected opening area
55, 59: Taper portion
57: Curved surface portion
61, 63, 63A: Intersection
62, 64: Closest point
66, 66A: Bottom portion
67: Transition portion
81: Chamber
82: Ignition coil
83: Voltage probe
84: Oscilloscope
101A, 101B, 101C: Edge
B1, B2: Protruding direction distance
C1, C2: Minimum distance
E: Peripheral edge portion
G: Spark gap P: Spark plug
X: Discharge start point
Y: Discharge end point
Z: Breakdown voltage
a, b: Distance
c, d, e, f: Dimension
g: Temperature measurement region

The invention claimed is:

1. A spark plug, comprising:

a center electrode;

a ground electrode bent to define a spark gap between a front end of the center electrode and an inner surface of the ground electrode facing the center electrode, wherein the ground electrode has a protrusion and a hole formed by extrusion process on a front end portion thereof;

wherein the protrusion protrudes by a protruding length A of 0.4 to 1 mm from the inner surface of the ground electrode toward the front end of the center electrode and includes a first straight portion formed in such a manner that a width of the protrusion in a cross section through a center axis of the protrusion is uniform along a center axis direction of the protrusion and that the first straight portion has a projected first straight portion area S1 of 1.5 to 3 $mm^2$ where the projected first straight portion area S1 is a projected area of the first straight portion on a plane perpendicular to the center axis of the protrusion; and wherein the hole has an opening formed at an outer surface of the ground electrode opposite the inner surface in such a manner that a contour of the first straight portion of the protrusion projected onto an imaginary plane perpendicular to the protruding direction of the protrusion is located inside of a contour of the opening projected on said imaginary plane and that a ratio (S2/S1) of a projected opening area S2 of the opening to the projected first straight portion area S1 is not less than 1.2.

2. The spark plug according to claim 1, wherein the hole includes a second straight portion that has an inner wall surface formed in such a manner that a width between opposite sides of the inner wall surface in a cross section through a center axis of the hole is uniform along a center axis direction of the hole, a bottom portion and a transition portion extending between the second straight portion and the bottom portion;

wherein the transition portion is in the form of a taper portion that has, in a cross section through the center axis of the hole, straight contours extending from ends of contours of the second straight portion to ends of a contour of the bottom portion; and wherein the hole has, in a cross section through the center axis of the hole, a distance a of 0.1 mm or greater and a distance b of 0.1 mm or greater where the distance a is a distance from an intersection of a contour of the bottom portion and a contour of the taper portion to an intersection of an extension line of a contour of the second straight portion and an extension line of the contour of the bottom portion; and the distance b is a distance from an intersection of the contour of the second straight portion and the contour of the taper portion to the intersection of the extension line of the contour of the second straight portion and the extension line of the contour of the bottom portion.

3. The spark plug according to claim 1, wherein the protrusion includes at least one edge formed on a surface of the first straight portion.

4. The spark plug according to claim 1, wherein the first straight portion of the protrusion has a curved surface located on a side thereof closer to a rear end of the ground electrode.

5. The spark plug according to claim 1, wherein the ground electrode has, in a cross section perpendicular to the center axis of the hole and in parallel to the outer surface, smallest thickness regions each defined between parts of contours of the hole and of the ground electrode and located on a front end side thereof.

6. The spark plug according to claim 1, wherein the ground electrode has, in a cross section through the center axis of the protrusion, a distance B of 0.3 mm or more and a distance C of 0.4 mm or more where the distance B is a distance from an intersection of an imaginary straight extension line of a contour of the first straight portion along the center axis of the protrusion and a contour of the hole to a closest point on an end of the straight contour of the first straight portion closest to a contour of the inner surface of the ground electrode; and the distance C is a distance from a corner of the hole on an end of the contour of the bottom portion to the closest point closer to the corner.

7. The spark plug according to claim 1, wherein the protrusion includes a protrusion base portion located between the inner surface and the first straight portion and having, in a cross section through the center axis of the protrusion, curved contours extending from contours of the inner surface to contours of the first straight portion; and wherein the protrusion base portion is formed with a radius of curvature of 0.1 to 0.3 mm between the first straight portion and the inner surface in such a manner that a contour of the protrusion base portion projected onto an imaginary plane perpendicular to the protruding direction of the protrusion is located inside a contour of the opening projected onto the imaginary plane perpendicular to the protruding direction of the protrusion.

8. The spark plug according to claim 1, wherein the protrusion and the hole satisfy a relationship of S4 <S1 <S2 where S1 is the projected first straight portion area; S2 is the projected opening area; and S4 is a projected bottom surface area of the hole as determined when the bottom portion of the hole, the first straight portion and the opening of the hole are projected on the imaginary plane perpendicular to the protruding direction of the protrusion.

9. The spark plug according to claim 1, wherein a ratio (V2/V1) of a volumetric capacity V2 of the hole to a volume V1 of the protrusion is 1.2 to 2.

10. The spark plug according to claim 2, wherein the protrusion includes at least one edge formed on a surface of the first straight portion.

* * * * *